US011594822B2

(12) United States Patent
Brandau

(10) Patent No.: US 11,594,822 B2
(45) Date of Patent: Feb. 28, 2023

(54) PARABOLIC REFLECTOR ANTENNAS WITH IMPROVED CYLINDRICALLY-SHAPED SHIELDS

(71) Applicant: CommScope Technologies LLC, Hickory, NC (US)

(72) Inventor: Ronald J. Brandau, Homer Glen, IL (US)

(73) Assignee: CommScope Technologies LLC, Hickory, NC (US)

( * ) Notice: Subject to any disclaimer, the term of this patent is extended or adjusted under 35 U.S.C. 154(b) by 45 days.

(21) Appl. No.: 17/355,517

(22) Filed: Jun. 23, 2021

(65) Prior Publication Data

US 2021/0376480 A1 Dec. 2, 2021

Related U.S. Application Data

(63) Continuation-in-part of application No. 16/649,294, filed on Mar. 20, 2020, now Pat. No. 11,075,464, and (Continued)

(51) Int. Cl.
*H01Q 13/06* (2006.01)
*H01Q 19/13* (2006.01)
(Continued)

(52) U.S. Cl.
CPC ..... *H01Q 19/134* (2013.01); *H01Q 13/06* (2013.01); *H01Q 13/065* (2013.01); *H01Q 15/16* (2013.01); *H01Q 19/193* (2013.01)

(58) Field of Classification Search
CPC .... H01Q 19/193; H01Q 19/134; H01Q 15/16; H01Q 19/19; H01Q 19/18; H01Q 13/065;
(Continued)

(56) References Cited

U.S. PATENT DOCUMENTS 2,605,416 A 7/1952 Foster
2,617,029 A 11/1952 Plummer et al.
(Continued)

FOREIGN PATENT DOCUMENTS

DE 8218480 U1 10/1985
EP 1489688 A1 12/2004
(Continued)

OTHER PUBLICATIONS

Extended European Search Report Corresponding to European Application No. 18917641.5 (8 pages) (dated Apr. 16, 2021).
(Continued)

*Primary Examiner* — Vibol Tan
(74) *Attorney, Agent, or Firm* — Myers Bigel, P.A.

(57) ABSTRACT

Parabolic reflector antennas advantageously support low side lobe radiation patterns for ETSI class 4 performance, by utilizing: (i) metal choke plates adjacent a distal end of a dielectric cone within a sub-reflector assembly, (ii) "lossy" material feed boom waveguide sleeves and/or (iii) extended length cylindrical shields lined with radiation absorbing materials. Relatively shallow and large diameter parabolic reflectors having an F/D ratio of greater than about 0.25 may be provided with one or more of the identified (i)-(iii) enhancements.

7 Claims, 23 Drawing Sheets

Related U.S. Application Data a continuation-in-part of application No. 16/640,161, filed on Feb. 19, 2020, now Pat. No. 11,075,466.

(51) Int. Cl.
*H01Q 15/16* (2006.01)
*H01Q 19/19* (2006.01)

(58) Field of Classification Search
CPC .. H01Q 1/1228; H01Q 13/02; H01Q 13/0266; H01Q 13/06; H01Q 15/14; H01Q 19/022; H01Q 19/132; H01Q 1/528
See application file for complete search history.

(56) References Cited

U.S. PATENT DOCUMENTS

| | | | | |
|---|---|---|---|---|
| 3,733,609 | A | 5/1973 | Bartlett | |
| 4,626,863 | A | 12/1986 | Knop et al. | |
| 4,673,945 | A | 6/1987 | Syrigos | |
| 4,673,947 | A | 6/1987 | Newham | |
| 4,963,878 | A | 10/1990 | Kildal | |
| 5,166,698 | A | 11/1992 | Ashbaugh et al. | |
| 5,461,394 | A | 10/1995 | Weber | |
| 5,907,310 | A | 5/1999 | Seewig et al. | |
| 5,959,590 | A | 9/1999 | Sanford et al. | |
| 5,973,652 | A | 10/1999 | Sanford et al. | |
| 6,020,859 | A | 2/2000 | Kildal | |
| 6,081,170 | A | 6/2000 | Enokuma | |
| 6,107,973 | A | 8/2000 | Knop et al. | |
| 6,137,449 | A | 10/2000 | Kildal | |
| 6,184,840 | B1 | 2/2001 | Hsin-Loug et al. | |
| 6,429,826 | B2 | 8/2002 | Karlsson et al. | |
| 6,456,253 | B1 | 9/2002 | Rummeli et al. | |
| 6,522,305 | B2 | 2/2003 | Sharman | |
| 6,697,027 | B2 | 2/2004 | Mahon | |
| 6,724,349 | B1 | 4/2004 | Baird et al. | |
| 6,862,000 | B2 | 3/2005 | Desargant et al. | |
| 6,919,855 | B2 | 7/2005 | Hills | |
| 6,985,120 | B2 | 1/2006 | Lewry et al. | |
| 6,995,727 | B2 | 2/2006 | Tuau et al. | |
| 7,075,492 | B1 | 7/2006 | Chen et al. | |
| 7,138,958 | B2 | 11/2006 | Syed et al. | |
| 7,280,081 | B2 | 10/2007 | Mahr | |
| 7,586,454 | B2 | 9/2009 | Morin et al. | |
| 7,907,097 | B2 | 3/2011 | Syed et al. | |
| 8,102,324 | B2 | 1/2012 | Tuau et al. | |
| 8,581,795 | B2 | 11/2013 | Simms et al. | |
| 9,019,164 | B2 * | 4/2015 | Brandau | H01Q 19/022 343/781 CA |
| 9,318,810 | B2 * | 4/2016 | Zelenski | H01Q 19/134 |
| 9,634,373 | B2 * | 4/2017 | Lee | H01Q 19/022 |
| 9,634,400 | B2 | 4/2017 | Zelenski et al. | |
| 9,653,814 | B2 | 5/2017 | Baekelandt et al. | |
| 9,831,563 | B2 | 11/2017 | Brandau | |
| 9,948,009 | B2 | 4/2018 | Brandau et al. | |
| 9,948,010 | B2 | 4/2018 | Brandau | |
| 10,170,844 | B2 | 1/2019 | Brandau et al. | |
| 10,454,182 | B2 | 10/2019 | Brandau et al. | |
| 10,468,744 | B2 | 11/2019 | Adriazola et al. | |
| 10,566,700 | B2 | 2/2020 | Brandau | |
| 2002/0008670 | A1 | 1/2002 | Sharman | |
| 2004/0257290 | A1 | 12/2004 | Gothard et al. | |
| 2005/0007288 | A1 | 1/2005 | Tuau et al. | |
| 2005/0017916 | A1 | 1/2005 | Lewry et al. | |
| 2005/0062663 | A1 | 3/2005 | Hills | |
| 2005/0099350 | A1 | 5/2005 | Gothard et al. | |
| 2009/0021442 | A1 | 1/2009 | Syed et al. | |
| 2009/0184886 | A1 | 7/2009 | Tuau et al. | |
| 2010/0188304 | A1 | 7/2010 | Clymer et al. | |
| 2010/0315307 | A1 | 12/2010 | Syed et al. | |
| 2011/0140983 | A1 | 6/2011 | Hills et al. | |
| 2011/0291914 | A1 | 12/2011 | Lewry et al. | |
| 2011/0309987 | A1 | 12/2011 | Haluba et al. | |
| 2012/0287007 | A1 | 11/2012 | Hills et al. | |
| 2013/0057444 | A1 | 3/2013 | Brandau et al. | |
| 2013/0057445 | A1 | 3/2013 | Simms et al. | |
| 2013/0271349 | A1 | 10/2013 | Curran et al. | |
| 2013/0300621 | A1 | 11/2013 | Brandau et al. | |
| 2014/0218248 | A1 | 8/2014 | Schulz et al. | |
| 2014/0247191 | A1 | 9/2014 | Mahon | |
| 2015/0016039 | A1 | 1/2015 | Oakley | |
| 2015/0042527 | A1 | 2/2015 | Brandau | |
| 2015/0091768 | A1 | 4/2015 | Zelenski | |
| 2016/0043474 | A1 | 2/2016 | Brandau et al. | |

FOREIGN PATENT DOCUMENTS

| | | | |
|---|---|---|---|
| WO | 9313570 | A1 | 7/1993 |
| WO | 9853525 | A1 | 11/1998 |
| WO | 2011073844 | A2 | 6/2011 |
| WO | 2011085650 | A1 | 7/2011 |
| WO | 2018057824 | A1 | 3/2018 |

OTHER PUBLICATIONS

International Search Report and Written Opinion of the International Searching Authority corresponding to International Application No. PCT/US2018/047147 (13 pages) (dated Oct. 25, 2019).
Liu et al. "Design of a Parabolic Reflector Antenna With a Compact Splash-plate Feed" 2013 Cross Strait Quad-Regional Radio Science and Wireless Technology Conference (pp. 241-244) (Jul. 21-25, 2013).
Schwering et al., United States Statutory Invention Registration No. H584 (11 pages) (Feb. 7, 1989).

* cited by examiner

PARABOLIC REFLECTOR ANTENNAS WITH IMPROVED CYLINDRICALLY-SHAPED SHIELDS

REFERENCE TO PRIORITY APPLICATIONS

This application is a continuation-in-part (CIP) of U.S. application Ser. No. 16/640,161, filed Feb. 19, 2020, now U.S. Pat. No. 11,075,466, and a continuation-in-part (CIP) of U.S. application Ser. No. 16/649,294, filed Mar. 20, 2020, now U.S. Pat. No. 11,075,464, the disclosures of which are hereby incorporated herein by reference.

FIELD OF THE INVENTION

The present invention relates to dual reflector antennas utilizing deep dish or shallow dish parabolic reflectors and, more particularly, to dual reflector antennas having improved control of signal radiation pattern characteristics.

BACKGROUND

Dual reflector antennas employing self-supported feeds direct a received signal, which is incident on the main reflector, onto a sub-reflector mounted adjacent to the focal region of the main reflector, which in turn directs the signal into a waveguide transmission line typically via a feed horn or aperture to the first stage of a receiver. When the dual reflector antenna is used to transmit a signal, the signals travel from the last stage of the transmitter system, via the waveguide, to the feed aperture, sub-reflector, and main reflector to free space.

The electrical performance of a reflector antenna is typically characterized by its gain, radiation pattern, cross-polarization and return loss performance. Efficient gain, radiation pattern and cross-polarization characteristics may be important for efficient microwave link planning and coordination, while a good return loss may be important for efficient radio operation. The above characteristics are determined by a feed system designed in conjunction with the main reflector profile.

Deep dish reflectors are reflector dishes wherein the ratio of the reflector focal length (F) to reflector diameter (D) (i.e., F/D ratio) is made less than or equal to 0.25, whereas shallow dish reflectors have an F/D ratio of greater than 0.25. Such deep dish designs can achieve improved radiation pattern characteristics without the need for a separate shield assembly when used with a carefully designed feed system which provides controlled dish illumination, particularly toward the edge of the dish. In contrast, shallow dish reflectors may utilize shield assemblies to achieve improved radiation characteristics. Examples of shield assemblies are disclosed in commonly owned U.S. Pat. No. 8,581,795 to Simms et al. and U.S. Pat. No. 9,019,164 to Brandau et al., the disclosures of which are hereby incorporated herein by reference.

An example of a dielectric cone feed sub-reflector configured for use with a dual reflector antenna is disclosed in commonly owned U.S. Pat. No. 6,919,855 to Hills ("the '855 patent"), the disclosure of which is hereby incorporated herein by reference. As disclosed by the '855 patent, a dual reflector antenna may utilize a generally conical dielectric block cone feed with a sub-reflector surface and a leading cone surface having a plurality of downward angled non-periodic perturbations concentric about a longitudinal axis of the dielectric block. The cone feed and sub-reflector dimensions are made to be relatively small to reduce blockage of the signal path from the reflector dish to free space. Although a significant improvement over prior designs, such configurations have signal patterns in which the sub-reflector edge and distal edge of the feed boom radiate a portion of the signal broadly across the reflector dish surface, including areas proximate the reflector dish periphery and/or a shadow area of the sub-reflector where secondary reflections with the feed boom and/or sub-reflector may be generated, degrading electrical performance. Furthermore, the plurality of angled features and/or steps in the dielectric block typically require relatively complex manufacturing procedures which increase the overall manufacturing cost.

Therefore it is the object of the invention to provide apparatus that overcome limitations in the prior art, and in so doing present solutions that allow feed designs to provide enhanced reflector antenna characteristics, which meet stringent electrical specifications over the entire operating band used for typical wireless communication links (e.g., microwave).

SUMMARY OF THE INVENTION

Parabolic reflector antennas according to embodiments of the present invention advantageously support low side lobe radiation patterns for ETSI class 4 performance, by utilizing: (i) metal choke plates adjacent a distal end of a dielectric cone within a sub-reflector assembly, (ii) "lossy" material feed boom waveguide sleeves and/or (iii) extended length cylindrical shields lined with radiation absorbing materials. In some of embodiments of the invention, relatively shallow and large diameter parabolic reflectors having an F/D ratio of greater than about 0.25 may be provided with one or more of the identified (i)-(iii) enhancements, where "F" denotes reflector focal length and "D" denotes reflector diameter.

In some of these embodiments, a parabolic reflector antenna can be provided with: a dish reflector and a feed boom waveguide having a promixal end coupled to the dish reflector and a sub-reflector assembly coupled to a distal end of the feed boom waveguide. The sub-reflector assembly can include a dielectric block coupled to a distal end of the feed boom waveguide and a sub-reflector on a distal end of the dielectric block. A metal choke plate can also be provided, which may be coupled to the distal end of the dielectric block. This metal choke plate may have a maximum diameter equal to or greater than an outer diameter of the sub-reflector. In addition, the metal choke plate may have at least one annular-shaped groove therein, which is spaced longitudinally relative to the distal end of the dielectric block. The metal choke plate and the sub-reflector may be formed of different materials.

According to further embodiments of the invention, a radiation absorbing sleeve may be provided, which is wrapped around at least a majority of a length of the feed boom waveguide. This radiation absorbing sleeve may be formed of a material selected from a group consisting of foam, rubber, plastics and liquid-filled mediums, for example. In addition, the dielectric block may be formed to have a plurality of annular-shaped grooves therein that are spaced along a length of the dielectric block (as measured along a longitudinal axis of the dielectric block), whereas the metal choke plate may have a plurality of annular-shaped grooves, which are spaced radially outward relative to a longitudinal axis of the dielectric block. The metal choke plate may also have at least one annular-shaped groove that is spaced along the longitudinal axis of the dielectric block relative to the annular-shaped grooves in the dielectric block.

According to additional embodiments of the invention, the sub-reflector assembly is configured to redirect a feed signal transmitted along the feed boom waveguide into an RF transmission signal, which is directed from the sub-reflector to an interior concave surface of the parabolic dish reflector with a maximum signal intensity at an angle in a range between about 35 degrees and about 60 degrees for F/D ratios in a range from about 0.25 to about 0.4. This angle is measured between a longitudinal axis of the feed boom waveguide and a line extending from a focal point of the dish reflector and the interior concave surface of the dish reflector. According to preferred aspects of these embodiments of the invention, the sub-reflector assembly is further configured so that the RF transmission signal has a 3 dB "half-power" beamwidth in a range between about 25 degrees and about 35 degrees and a 10 dB beamwidth in a range between about 35 degrees and about 45 degrees, where the half-power beamwidth is the angle between the half-power (−3 dB) points of the main lobe, when referenced to the peak effective radiated power of the main lobe.

According to still further embodiments of the invention, the sub-reflector assembly can include a choke plate coupled to the distal end of the dielectric block, with the choke plate having a maximum diameter equal to or greater than an outer diameter of the sub-reflector. The choke plate may have at least one annular-shaped groove therein, which is spaced longitudinally relative to the distal end of the dielectric block. In particular, the dielectric block may have an annular-shaped groove therein at a first radius relative to a longitudinal axis of the feed boom waveguide and the choke plate may have an annular-shaped groove therein at a second radius relative to the longitudinal axis of the feed boom waveguide, which is greater than the first radius. The choke plate may also have a plurality of annular-shaped grooves therein, which are spaced radially (from each other) relative to the longitudinal axis of the dielectric block.

Additional embodiments of the invention may also include a parabolic reflector antenna containing a dish reflector and a feed boom waveguide having a promixal end coupled to an interior of the dish reflector. A cylindrically-shaped shield, which is coupled to a periphery of the dish reflector, is also provided. The shield has a distal peripheral edge (e.g., rim), which is sufficiently spaced from the periphery of the dish reflector so that a subtended angle between a longitudinal axis of the feed boom and a line extending from a focal point of the dish reflector to a point on the distal peripheral edge of the shield is about 50 degrees or less. According to preferred aspects of these embodiments of the invention, a radiation absorbing sleeve is also provided, which is wrapped around at least a majority of a length of the feed boom waveguide to thereby enhance the radiation patterns of the antenna. This radiation absorbing sleeve may include a material selected from a group consisting of foam, rubber, plastics and liquid-filled mediums. A sub-reflector assembly may also be provided, which includes: (i) a dielectric block coupled to a distal end of the feed boom waveguide, (ii) a sub-reflector on a distal end of the dielectric block; and (iii) a metal choke plate extending adjacent the sub-reflector. This metal choke plate, which may have a maximum diameter equal to or greater than an outer diameter of the sub-reflector, may contain at least one annular-shaped groove therein, which is spaced longitudinally relative to the distal end of the dielectric block. In particular, the dielectric block may have an annular-shaped groove therein at a first radius relative to a longitudinal axis of the feed boom waveguide and the metal choke plate may have an annular-shaped groove therein at a second radius relative to the longitudinal axis of the feed boom waveguide, which is greater than the first radius. The metal choke plate may also have a plurality of annular-shaped grooves therein, which are spaced radially relative to the longitudinal axis of the dielectric block. A radiation absorbing liner may also be provided on at least a portion of an interior surface of the cylindrically-shaped shield. This radiation absorbing liner may be provided as a foam absorbers, resonant rubber absorbers and "lossy" dielectric materials, etc.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION OF EMBODIMENTS

Figure 1:
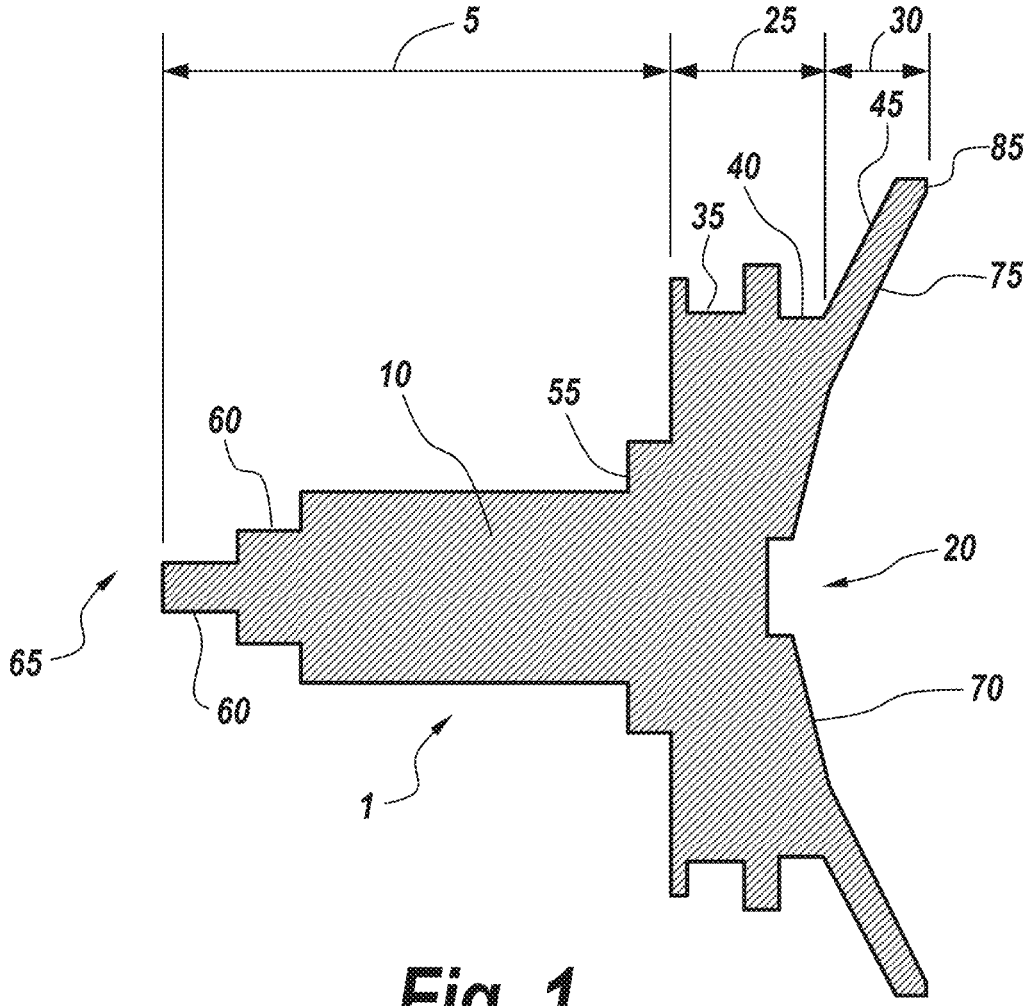
FIG. 1 is a schematic cut-away side view of an exemplary controlled illumination dielectric cone sub-reflector assembly.

The present invention now will be described more fully with reference to the accompanying drawings, in which preferred embodiments of the invention are shown. This invention may, however, be embodied in many different forms and should not be construed as being limited to the embodiments set forth herein; rather, these embodiments are provided so that this disclosure will be thorough and complete, and will fully convey the scope of the invention to those skilled in the art. Like reference numerals refer to like elements throughout.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise. It will be further understood that the terms "comprising", "including", "having" and variants thereof, when used in this specification, specify the presence of stated features, steps, operations, elements, and/or components, but do not preclude the presence or addition of one or more other features, steps, operations, elements, components, and/or groups thereof. In contrast, the term "consisting of" when used in this specification, specifies the stated features, steps, operations, elements, and/or components, and precludes additional features, steps, operations, elements and/or components.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As will now be described herein, improvements in radiation pattern control and thus overall reflector antenna performance may be realized by reducing or minimizing the electrical effect of the feed boom end and sub-reflector overspill upon the radiation pattern of conventional dielectric cone sub-reflector assemblies, by providing reflector dish illumination that is spaced away from the vertex area of the reflector dish.

Figure 2:
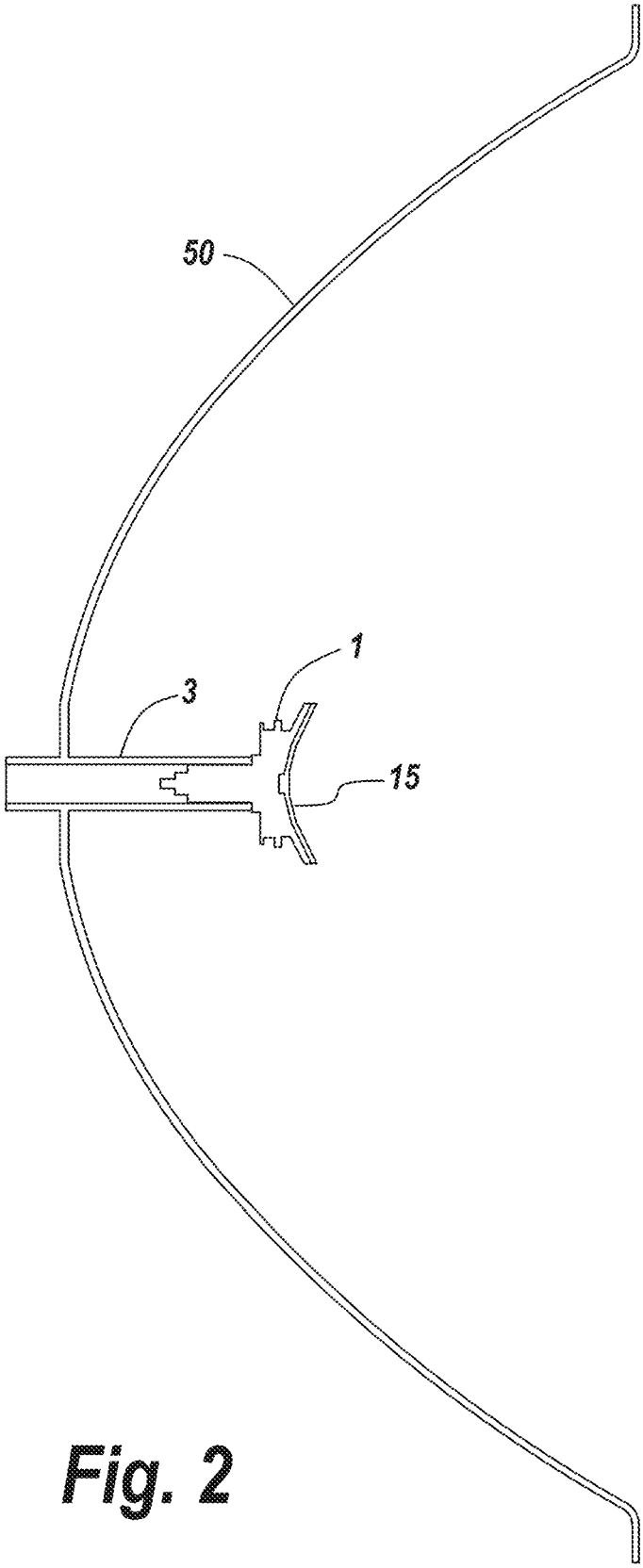
FIG. 2 is a schematic cut-away side view of the sub-reflector assembly of FIG. 4, mounted within a 0.167 F/D deep dish reflector antenna.
Figure 4:
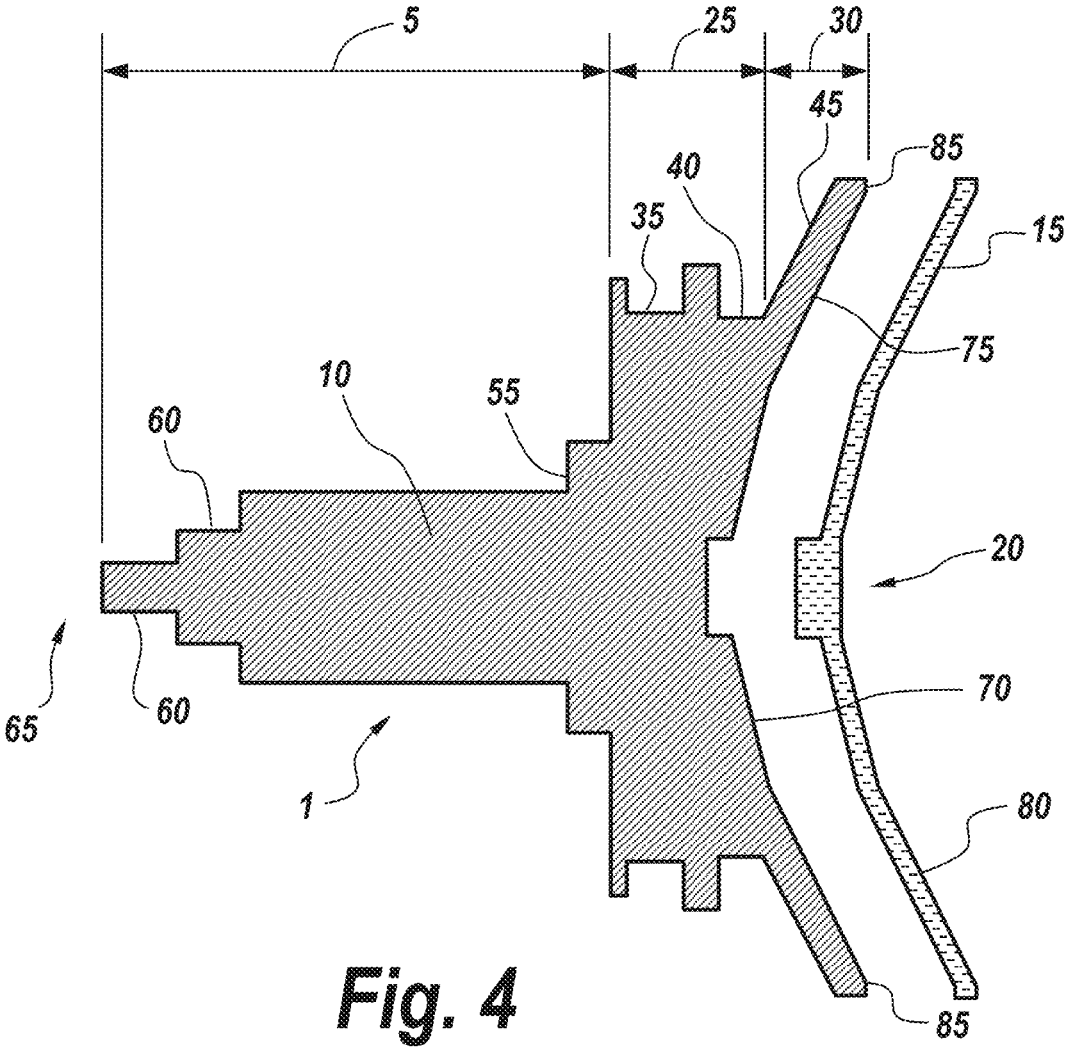
FIG. 4 is an exploded schematic cut-away side view of the sub-reflector assembly of FIG. 1, illustrated with a separate metal disc type sub-reflector.

As shown in FIGS. 1, 2 and 4 and TABLE 1, a cone radiator sub-reflector assembly 1 is configured to couple with the end of a feed boom waveguide 3 at a waveguide transition portion 5 of a unitary dielectric block 10 which supports a sub-reflector 15 at the distal end 20. The sub-reflector assembly 1 utilizes an enlarged sub-reflector diameter for reduction of sub-reflector spill-over. The sub-reflector 15 may be dimensioned, for example, with a diameter that is 2.5 wavelengths or more of a desired operating frequency, such as the mid-band frequency of a desired microwave frequency band. The exemplary embodiment is dimensioned with a 39.34 mm outer diameter and a minimum dielectric radiator portion diameter of 26.08 mm, which at a desired operating frequency in the 22.4 GHz microwave band corresponds to 2.94 and 1.95 wavelengths, respectively.

Figure 3:
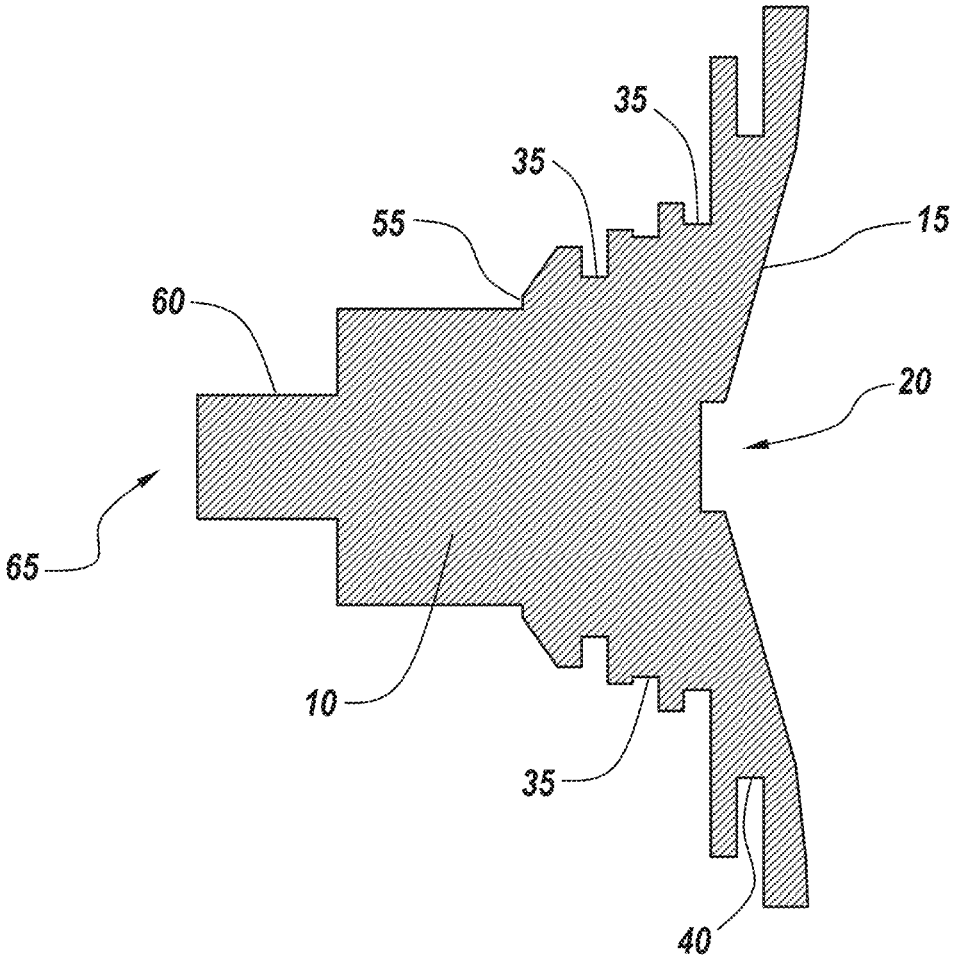
Fig. 3 (Prior Art)
FIG. 3 is a schematic cut-away side view of a prior art dielectric cone sub-reflector assembly.

A generally cylindrical dielectric radiator portion 25 situated between the waveguide transition portion 5 and a sub-reflector support portion 30 of the dielectric block 10 is also increased in size. The dielectric radiator portion 25 may be dimensioned, for example, with a minimum diameter of at least ⅗ of the sub-reflector diameter. The enlarged dielectric radiator portion 25 is operative to pull signal energy outward from the end of the waveguide 3, thus minimizing the diffraction at this area observed in conventional dielectric cone sub-reflector configurations, for example as shown in FIG. 3. The conventional dielectric cone has an outer diameter of 28 mm and a minimum diameter in a "radiator region" of 11.2 mm, which at a desired operating frequency in the 22.4 GHz microwave band corresponds to corresponding to 2.09 and 0.84 wavelengths, respectively. In contrast to the generally cylindrical dielectric radiator portion 25 of the exemplary dielectric cone of FIGS. 1, 2 and 4, the conventional dielectric cone of FIG. 3 has a generally conical progressively increasing diameter characteristic typical of the prior mindset that the only purpose of the dielectric block 10 was to support the sub reflector 15 while attempting to minimize surface currents via choke grooves 35 provided in the outer surface of the dielectric block 10.

A plurality of corrugations are provided along the outer diameter of the dielectric radiator portion as radial inward grooves 35. The radial inward grooves 35 may be provided perpendicular to a longitudinal axis of the dielectric block 10. In the present embodiment of FIGS. 1-2 and 4 (and in the embodiments of FIGS. 12A-12H), the plurality of grooves includes two grooves 35. A distal groove 40 of the dielectric radiator portion 25 may be provided with an angled distal sidewall 45 that initiates the sub-reflector support portion 30. The distal sidewall 45 may be generally parallel to a longitudinally adjacent portion of the distal end 20. Accordingly, the distal sidewall 45 may form a conical surface parallel to the longitudinally adjacent conical surface of the distal end 20 supporting the sub-reflector 15, so that a dielectric thickness along this surface is constant with respect to the sub-reflector 45.

The waveguide transition portion 5 of the sub-reflector assembly 1 may be adapted to match a desired circular waveguide internal diameter so that the sub-reflector assembly 1 may be fitted into and retained by the feed boom waveguide 3 that supports the sub-reflector assembly 1 within the dish reflector 50 of the reflector antenna proximate a focal point of the dish reflector 50. The waveguide transition portion 5 may insert into the waveguide 3 until the end of the waveguide abuts a shoulder 55 of the waveguide transition portion 5.

The shoulder 55 may be dimensioned to space the dielectric radiator portion 25 away from the waveguide end and/or to further position the periphery of the distal end 20 (the farthest longitudinal distance of the sub-reflector signal surface from the waveguide end) at least 0.75 wavelengths of the desired operating frequency. The exemplary embodiment is dimensioned with a 14.48 mm longitudinal length, which at a desired operating frequency in the 22.4 GHz microwave band corresponds to 1.08 wavelengths. For comparison, the conventional dielectric cone of FIG. 3 is dimensioned with 8.83 mm longitudinal length or 0.66 wavelengths at the same desired operating frequency. In addition, one or more step(s) 60 at the proximal end 65 of the waveguide transition portion 5 and/or one or more groove(s) may be used for impedance matching purposes between the waveguide 3 and the dielectric material of the dielectric block 10.

As shown best by FIGS. 1 and 4, the sub-reflector assembly 1 is demonstrated with a proximal conical surface 70 which transitions to a distal conical surface 75, the distal conical surface 75 provided with a lower angle with respect to a longitudinal axis of the sub-reflector assembly 1 than the proximal conical surface 70. The sub-reflector of FIG. 1 may be formed by applying a metallic deposition, film, sheet or other RF reflective coating to the distal end 20 of the dielectric block 10 (i.e., to the concave/conical surfaces 70, 75 of the sub-reflector support portion 30). Alternatively, as shown in FIGS. 2 and 4, the sub-reflector 15 may be formed separately as a metal disk 80 which seats upon the distal end 20 of the dielectric block 10.

TABLE 1

| Table of Parts | |
|---|---|
| 1 | sub-reflector assembly |
| 3 | Waveguide |
| 5 | waveguide transition portion |
| 10 | dielectric block |
| 15 | sub-reflector |
| 20 | distal end |
| 25 | dielectric radiator portion |
| 30 | sub-reflector support portion |
| 35 | Groove |
| 40 | distal groove |
| 45 | distal sidewall |
| 50 | dish reflector |
| 55 | shoulder |
| 60 | Step |
| 65 | proximal end |
| 70 | proximal conical surface |
| 75 | distal conical surface |
| 80 | Disk |
| 85 | reference surface |
| 90 | Shield |
| 95 | RF absorbing material |

Figure 5:
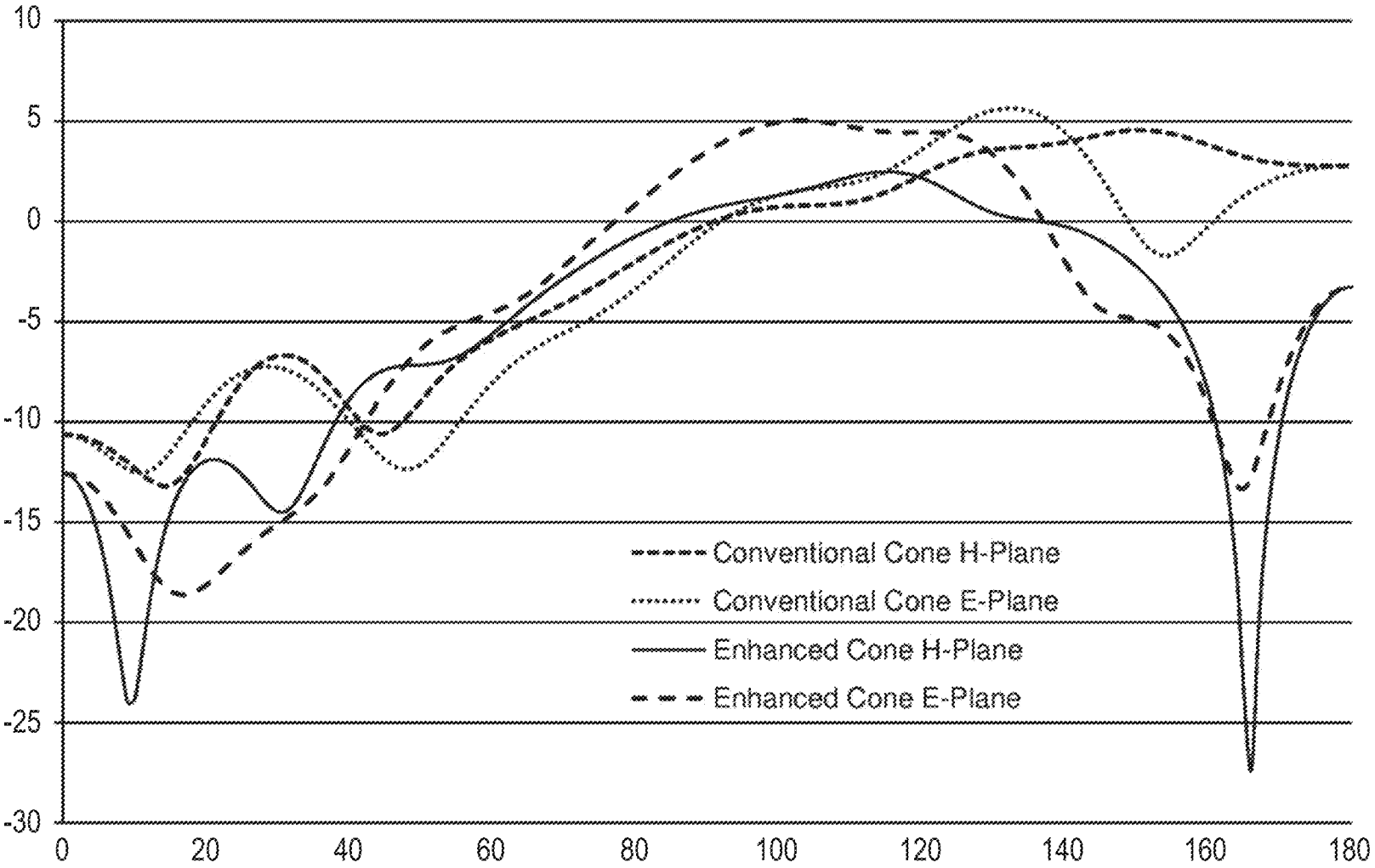
FIG. 5 is an E & H plane primary radiation amplitude pattern modeled comparison chart (180° is boresight) for the sub-reflector assemblies of FIG. 1 and FIG. 3 operating at 22.4 GHz, wherein the dot line is FIG. 3 E plane, short dash line is FIG. 3 H Plane, long dash line is FIG. 1 E plane and the solid line is FIG. 1 H plane.
Figure 6:
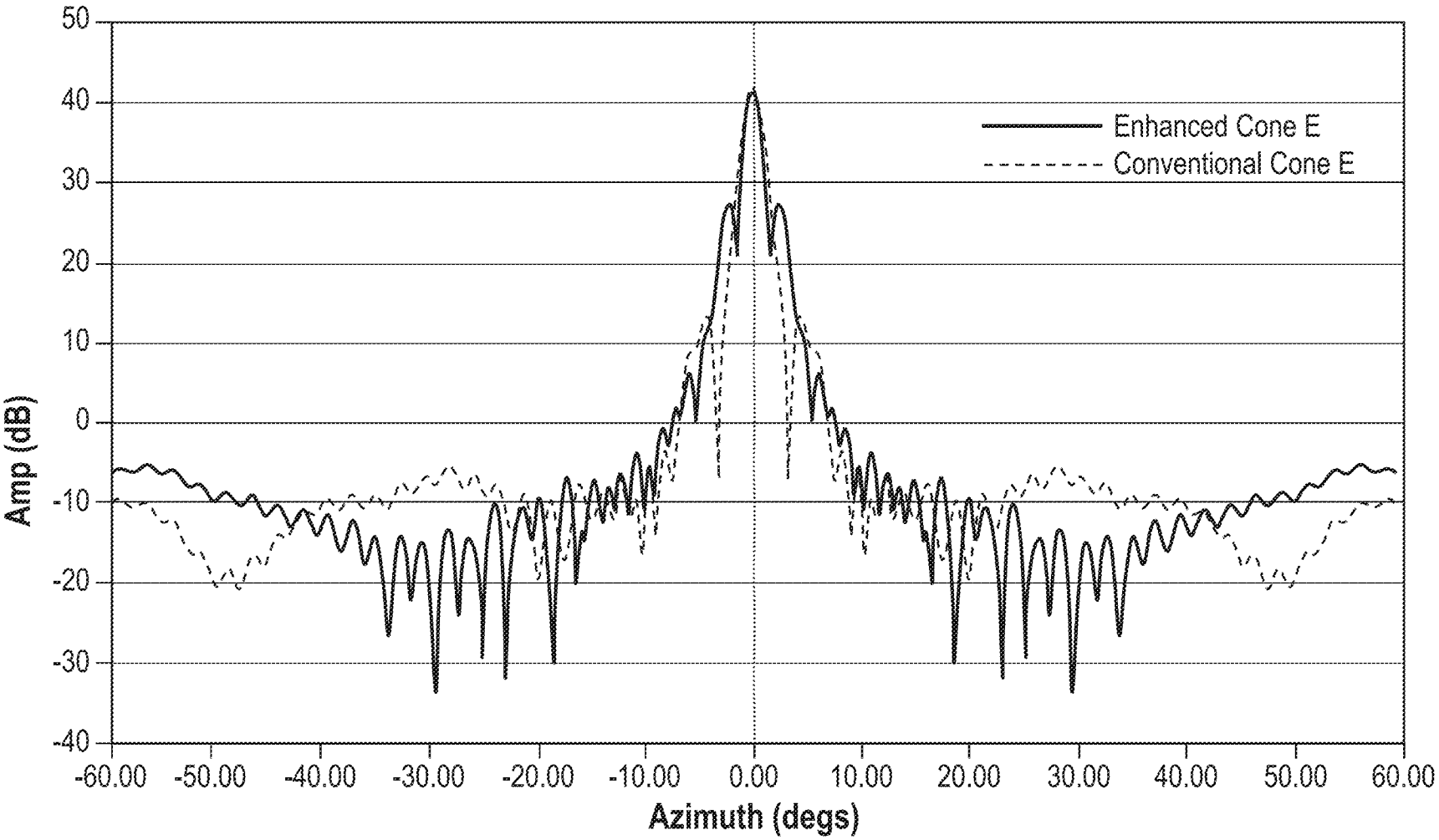
FIG. 6 is an E plane radiation pattern model comparison chart for the dielectric cone feeds of FIG. 1 and FIG. 3 mounted within a 0.167 F/D reflector dish according to FIG. 2.
Figure 7:
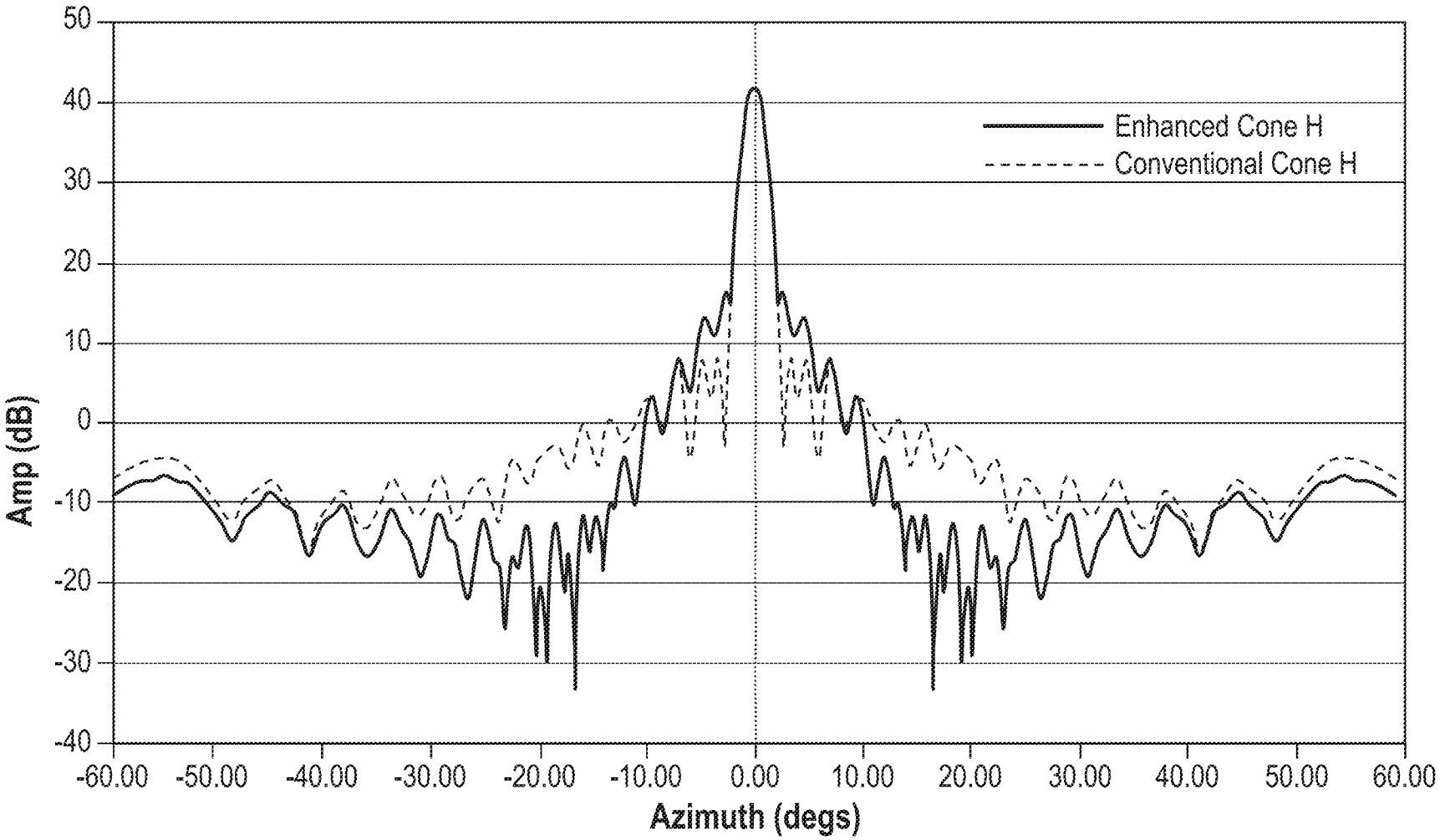
FIG. 7 is an H plane radiation pattern model comparison chart for the dielectric cone feeds of FIG. 1 and FIG. 3 mounted within a 0.167 F/D reflector dish according to FIG. 2.

When applied with an 0.167 F/D deep dish reflector 50, the sub-reflector assembly 1 provides surprising improvements in the signal pattern, particularly in the region between 10 and 45 degrees. For example, as shown in FIGS. 5-7, radiation in both the E & H planes is significantly reduced in the 10 to 45 degree region.

Figure 8:
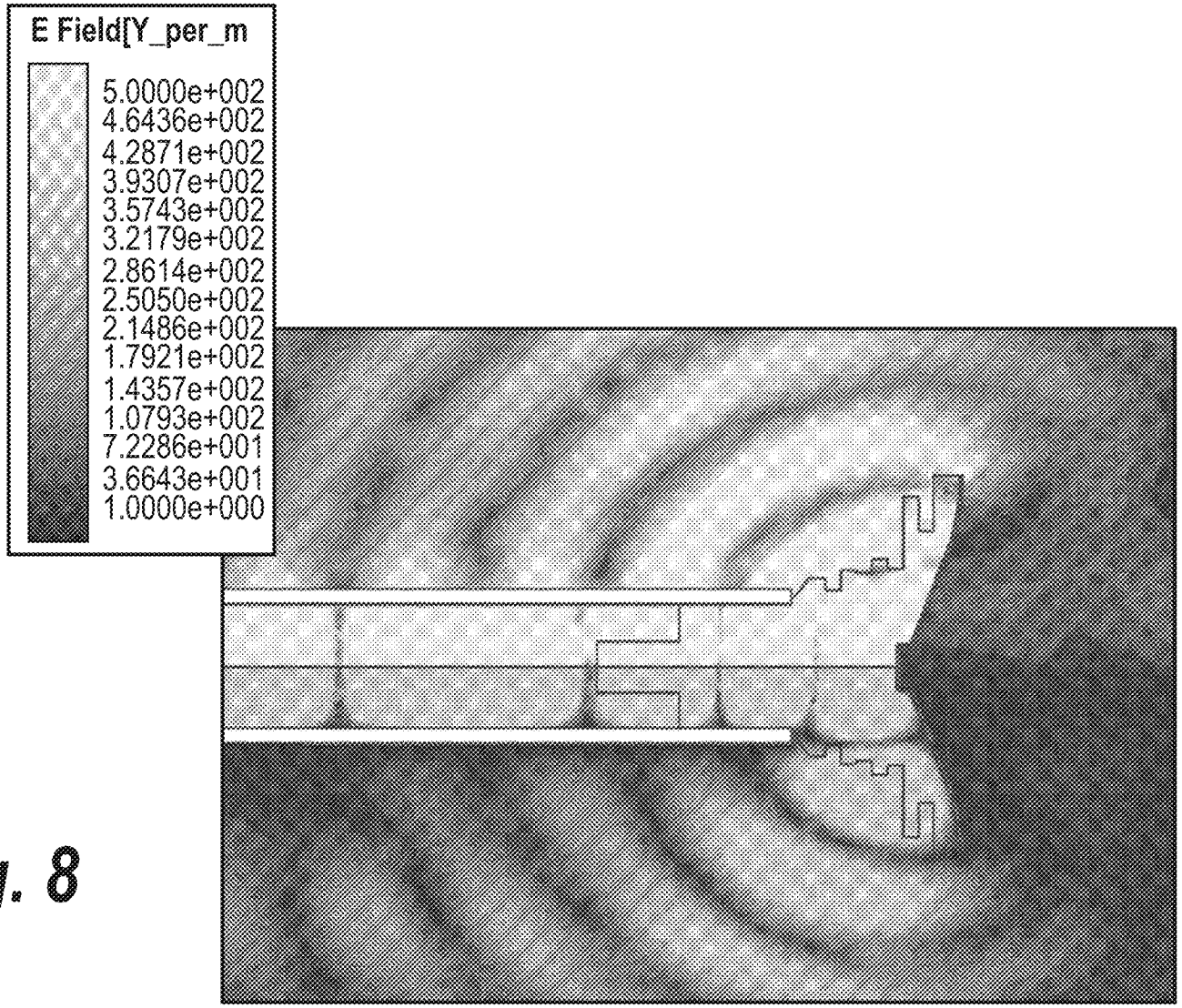
FIG. 8 is an E (top half) & H (bottom half) plane energy field distribution model for the sub-reflector assembly of FIG. 3 (model is a planar rendering of quarter symmetry).

FIG. 8 demonstrates a time slice radiation energy plot simulation of a conventional sub-reflector assembly of FIG. 3, showing the broad angular spread of the radiation pattern towards a concave inner surface of a reflector dish and in particular the diffraction effect of the waveguide end drawing the signal energy back along the boresight toward the vertex area which necessitates the limiting of the sub-reflector diameter to prevent significant signal blockage and/or introduction of electrical performance degrading secondary reflections/interference.

Figure 9:
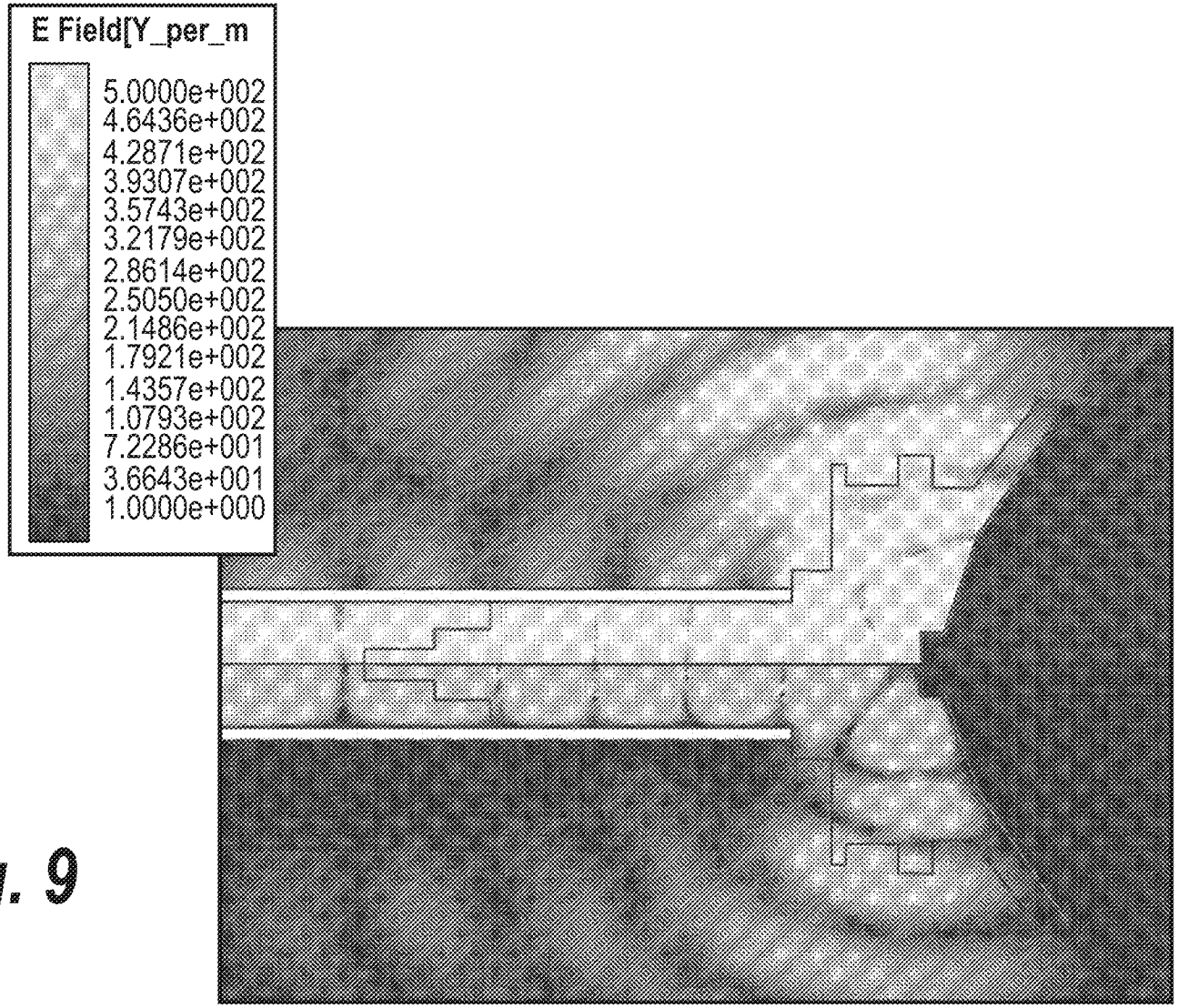
FIG. 9 is an E (top half) & H (bottom half) plane primary energy field distribution model for the sub-reflector assembly of FIG. 1 (model is a planar rendering of quarter symmetry).

In contrast, FIG. 9 shows a radiation energy plot simulation of the exemplary controlled illumination cone radiator sub-reflector assembly 1 demonstrating the controlled illumination of the dish reflector 50 by the sub-reflector assembly 1 as the radiation pattern is directed primarily towards an area of the dish reflector 50 spaced away both from the sub-reflector shadow area and the periphery of the dish reflector 50.

The illumination of the concave inner surface of the dish reflector 50 by the exemplary controlled illumination cone radiator sub-reflector assembly 1 utilizing the enhanced dielectric radiator portion 25 results in dish reflector illumination wherein both the maximum signal intensity and the majority of dish reflector illumination, in general, are shifted outward along the dish reflector surface, away from the vertex area.

Figure 10:
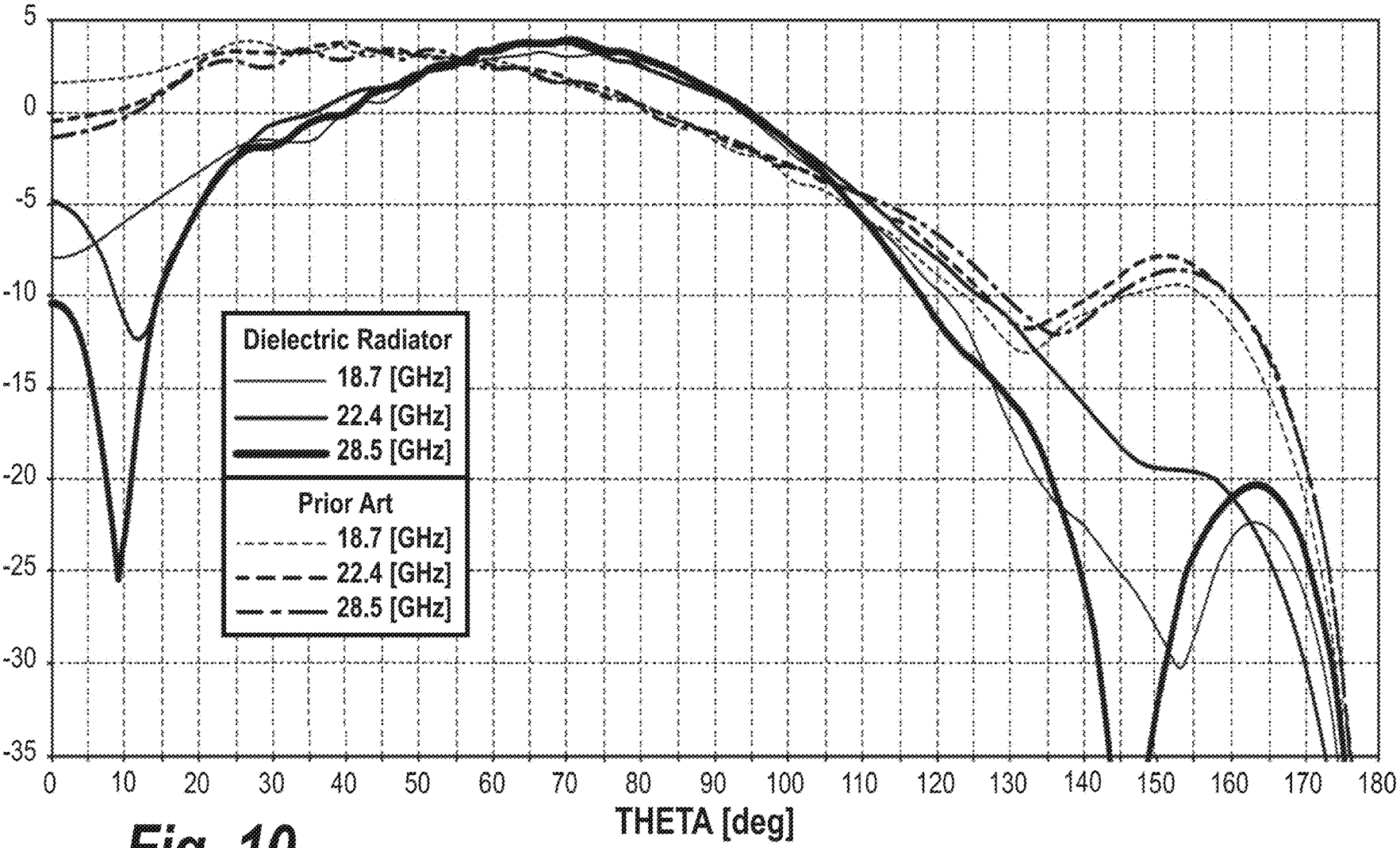
FIG. 10 is a 45 degree plane primary radiation pattern for 0.168 RD dish reflector illumination amplitude versus angle from the focal point modeled comparison chart for sub-reflector and dish assemblies of FIGS. 1 and 3 configured for and operating at 18.7, 22.4 and 28.5 GHz. The varied dot/dashed lines are the prior art sub-reflector assembly and the varied width solid lines are the exemplary sub-reflector assembly, wherein 0° is the dish reflector vertex.
Figure 11:
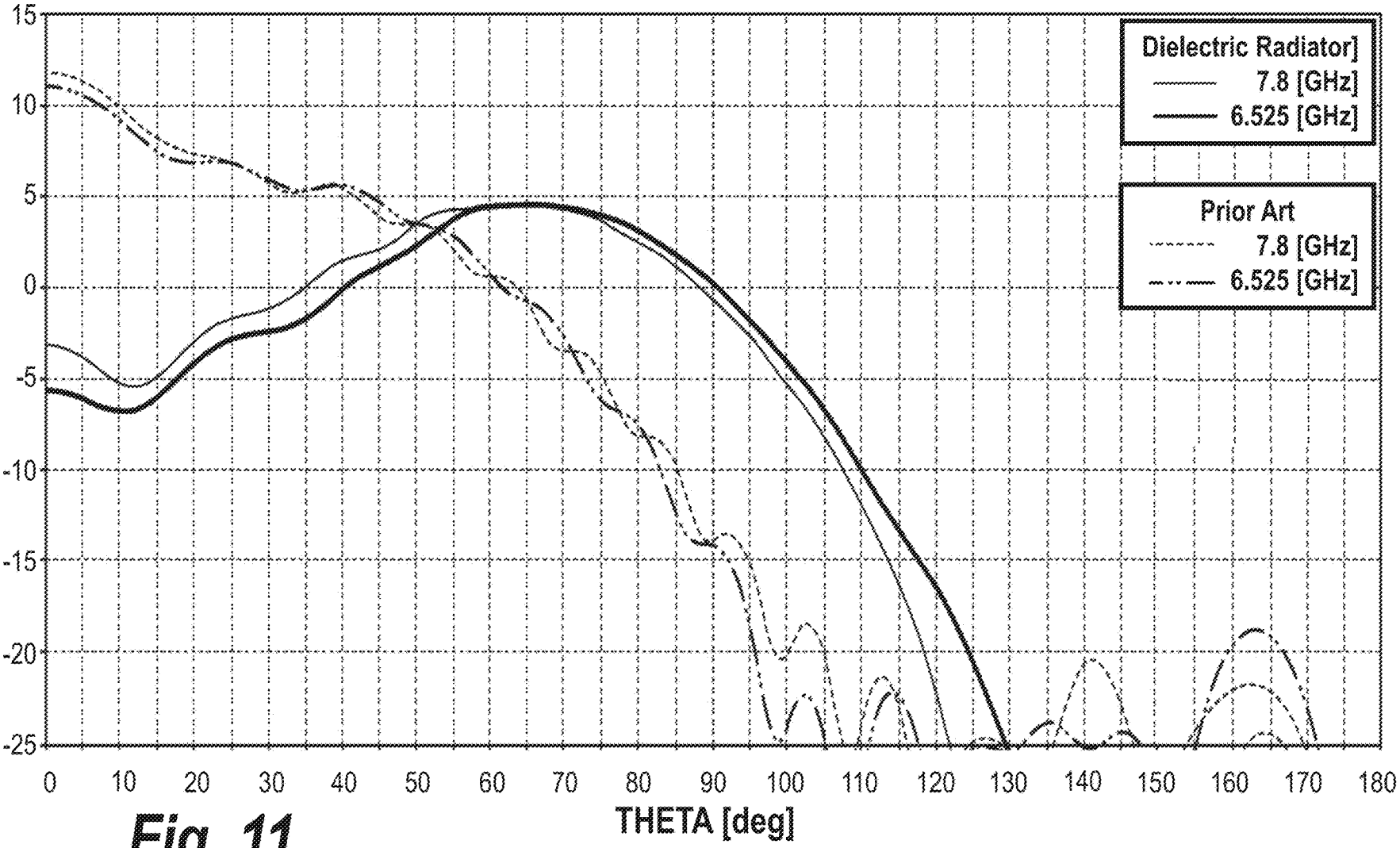
FIG. 11 is a 45 degree plane primary radiation pattern for 0.25 RD dish reflector illumination amplitude versus angle from the focal point modeled comparison chart for sub-reflector and dish assemblies of FIGS. 1 and 3 configured for and operating at 6.525 and 7.8 GHz. The varied dot/dashed lines are the prior art sub-reflector assembly and the varied width solid lines are the exemplary sub-reflector assembly, wherein 0° is the dish reflector vertex.

In addition, as shown by the dish reflector illumination amplitude charts of FIGS. 10 and 11, the illumination of the dish reflector, identified with respect to an angle between the longitudinal axis of the waveguide and a line between the focal point of the dish reflector and the dish reflector surface is not only shifted outward from the vertex area, but illumination of the vertex area is reduced to surprisingly low levels resulting in an angular range of primary dish reflector illumination, instead of vertex area illumination as the primary dish reflector illumination, as shown with respect to the prior art sub reflector assemblies without a dielectric radiator portion 25.

For ease of demonstration, FIGS. 10 and 11 are provided in 45 degree plane format, an averaging of the E and H plane performance that is thus representative of an annular illumination pattern of the dish reflector, at the indicated illumination intensity, over 360 degrees around the dish reflector surface at each indicated angle from the vertex area (0 degrees) to the dish reflector periphery (180 degrees).

One skilled in the art will appreciate that in the exemplary embodiments utilizing the dielectric radiator portion 25 the resulting illumination pattern forms an annular region of illumination intensity coaxial with the longitudinal axis of the waveguide, that is—in contrast with the prior art, there is minimal signal illumination (effectively a null) at the vertex area, one of the aspects of the invention which enables enlarged sub reflector diameters without introducing corresponding signal blockage.

The shifting of the dish reflector illumination outward from the vertex area is demonstrated in solutions for exemplary 0.168 and 0.25 F/D deep dish reflectors and sub-reflector assemblies in FIGS. 10 and 11, respectively. In particular, with respect to FIG. 10, the exemplary embodiment has a maximum signal intensity that occurs at 66 degrees @ 22.4 GHz and 70 degrees @ both 18.7 and 28.5 GHz. Further, the dish reflector is illuminated with a signal intensity within 3 dB of the maximum signal intensity only within an angular range between 38 and 93 degrees. In contrast, the prior art assembly does not have an illumination drop-off greater than 3 dB from the peak, all the way to 0 degrees (the illumination peak is effectively proximate the vertex area). And, with respect to FIG. 11, the exemplary embodiment has a maximum signal intensity that occurs at 64 degrees @ 7.8 GHz and 65 degrees @ 6.525 GHz in the respective assemblies. Further, the dish reflector is illuminated with a signal intensity within 3 dB of the maximum signal intensity only within an angular range between 40 and 86 degrees. Here again, the prior art assembly has a peak illumination that is effectively the center of vertex area, an area that is shielded by the sub reflector.

One skilled in the art will appreciate that while additional shielding and/or radiation absorbing materials may be applied to assist with correction of the radiation pattern with respect to the vertex and/or sub-reflector spill-over regions, the reduction in these regions, along with the previously unobtainable 10 to 45 degree region radiation reduction has been obtained in the present example without any such additional structure. As this signal pattern improvement is made without absorbing the signal energy projected in unwanted directions by additional means, more of the signal energy is applied to the free space target, resulting in a 6% improved antenna efficiency measured by the inventor's software based models of the exemplary embodiment operating in the 22.4 GHz microwave band.

Where each of the shoulders 55, steps 60 and grooves 35 formed along the outer diameter of the unitary dielectric block are provided radially inward, manufacture of the dielectric block 10 may be simplified, reducing overall manufacturing costs. Dimensioning the periphery of the distal surface as normal to the longitudinal axis of the assembly provides a ready manufacturing reference surface 85, further simplifying the dielectric block 10 manufacture process, for example by machining and/or injection molding.

Figure 12A:
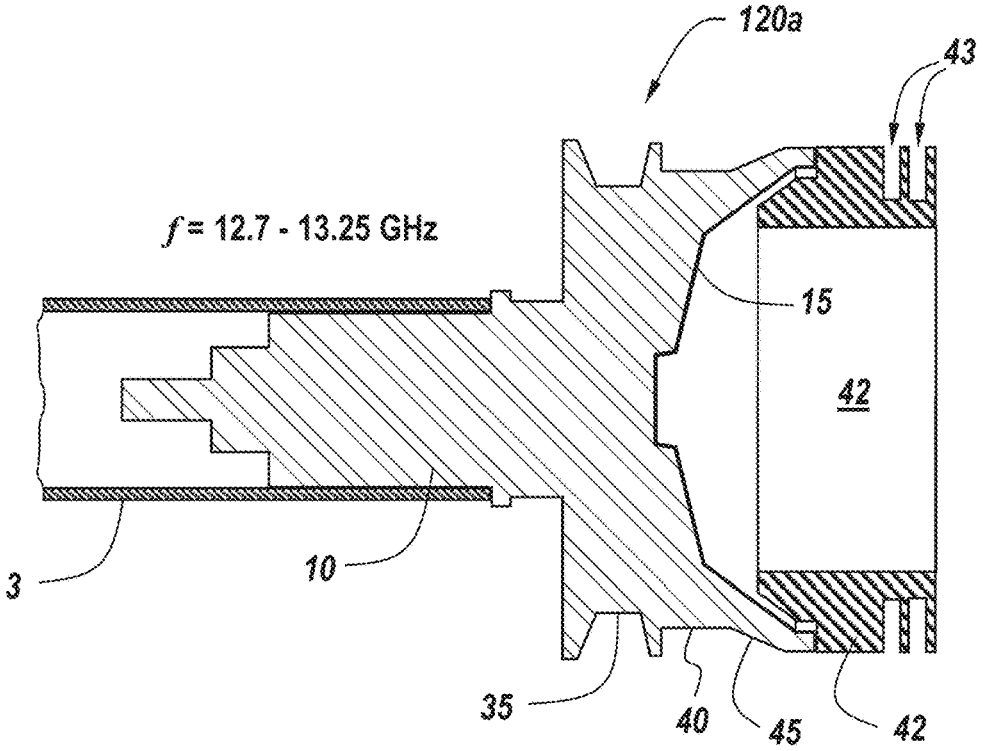
FIG. 12A is a cut-away side view of a dielectric cone sub-reflector assembly with metal choke plate for 12.7-13.25 GHz operation, according to an embodiment of the present invention (for F/D 0.25).

According to further embodiments of the invention, the unitary dielectric blocks 10 associated with the sub-reflector assemblies 1 of FIGS. 1-2 and 4 may be modified to support the specific frequency ranges shown by FIGS. 12A-12H (for F/D≤0.25). In particular, as illustrated by FIG. 12A, a sub-reflector assembly 120*a*, which may be configured to preferentially support frequencies (t) in a range from about 12.7 GHz to about 13.25 GHz, includes a dielectric block 10 disposed within a feed boom waveguide 3 and a sub-reflector (e.g., metal reflector) 15 at a distal end of the dielectric block 10. As described hereinabove, a plurality of corrugations are provided in the dielectric block 10, as radial inward grooves, which are shown as a proximal groove 35 and a distal groove 40 having an angled distal sidewall 45 that defines a sub-reflector support portion of the dielectric block 10. The sub-reflector assembly 120*a* of FIG. 12A also includes a metal choke plate 42, which is coupled to the distal end of the dielectric block 10. This metal choke plate 42, which has a diameter equal to or greater than an outer diameter of the dielectric block 10 and sub-reflector 15, may include a plurality of annular-shaped grooves 43, which are spaced apart relative to each other and spaced along a longitudinal axis of the dielectric block 10 relative to the grooves 35, 40 therein.

Figure 12B:
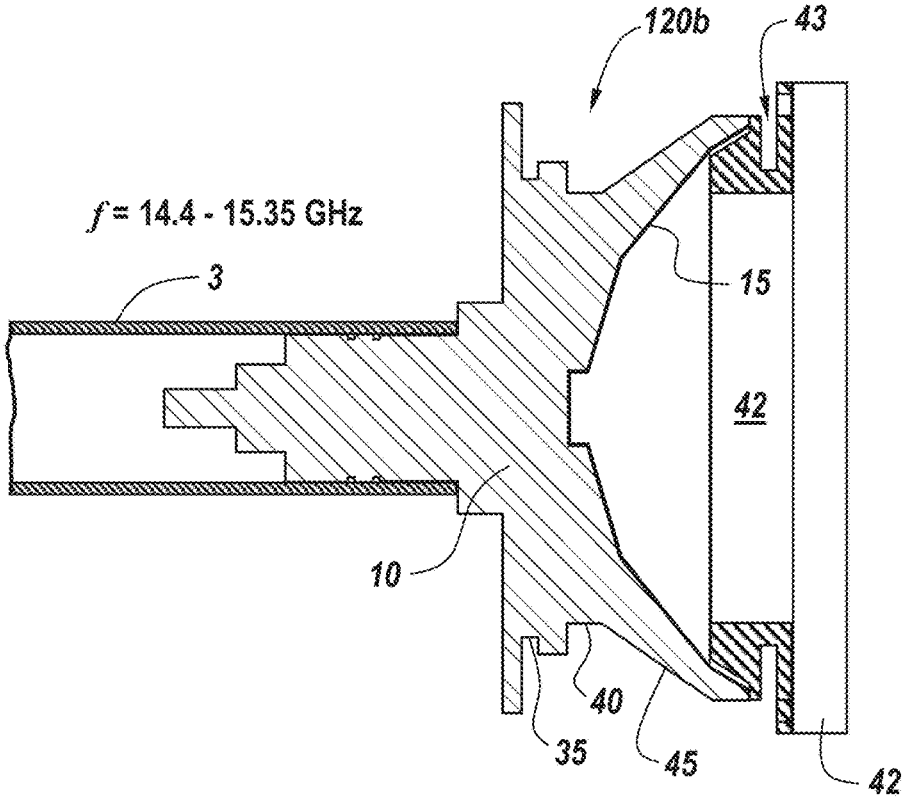
FIG. 12B is a cut-away side view of a dielectric cone sub-reflector assembly with metal choke plate for 14.4-15.35 GHz operation, according to an embodiment of the present invention (for F/D 0.25).
Figure 12C:
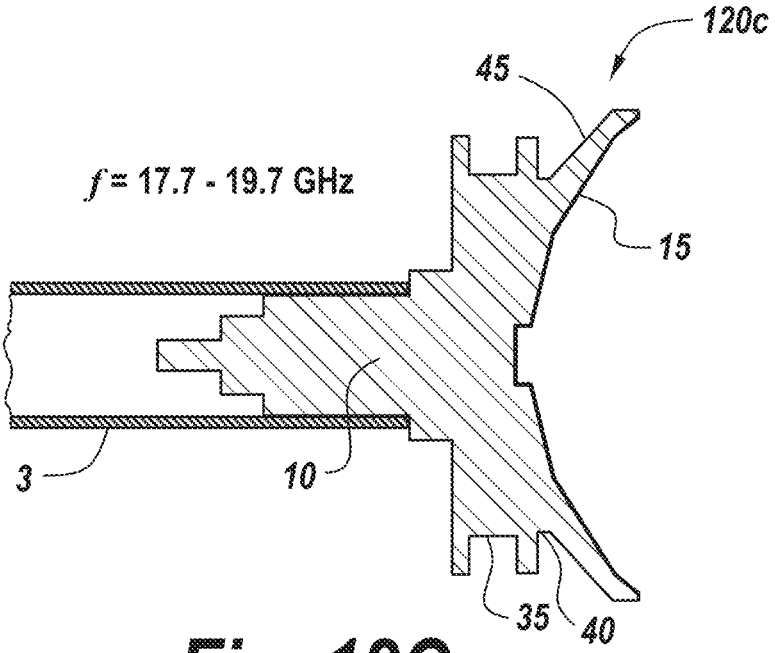
FIG. 12C is a cut-away side view of a dielectric cone sub-reflector assembly for 17.7-19.7 GHz operation, according to an embodiment of the present invention (for F/D≤0.25).
Figure 12D:
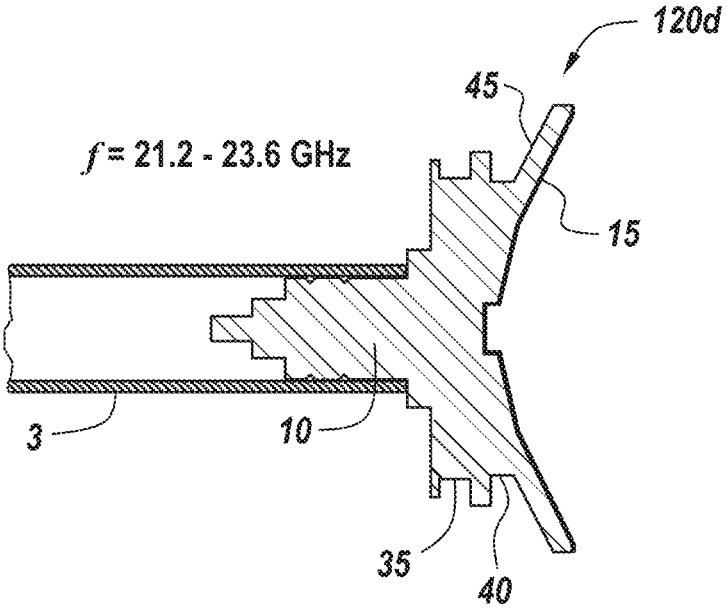
FIG. 12D is a cut-away side view of a dielectric cone sub-reflector assembly for 21.2-23.6 GHz operation, according to an embodiment of the present invention (for F/D≤0.25).
Figure 12E:
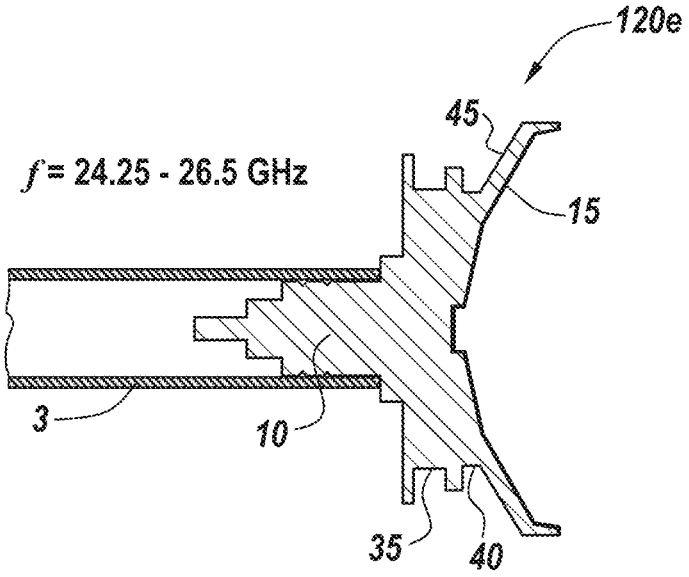
FIG. 12E is a cut-away side view of a dielectric cone sub-reflector assembly for 24.25-26.5 GHz operation, according to an embodiment of the present invention (for F/D≤0.25).
Figure 12F:
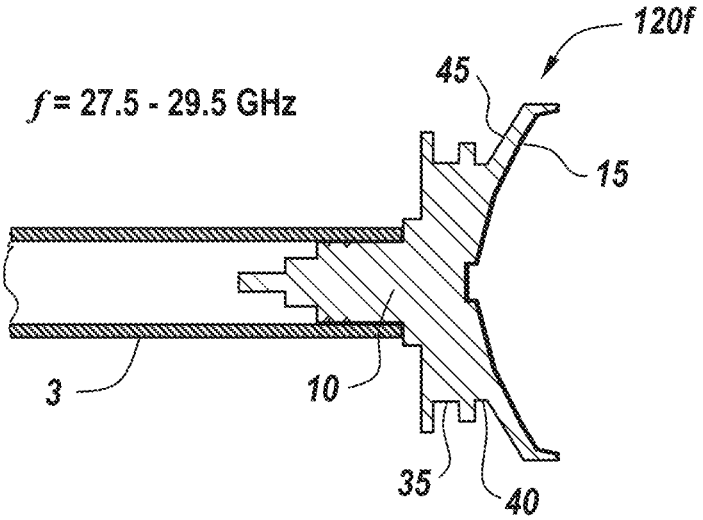
FIG. 12F is a cut-away side view of a dielectric cone sub-reflector assembly for 27.5-29.5 GHz operation, according to an embodiment of the present invention (for F/D≤0.25).
Figure 12G:
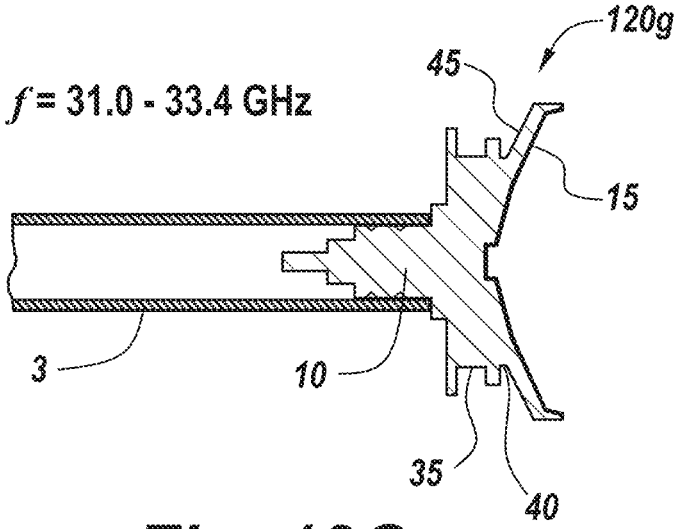
FIG. 12G is a cut-away side view of a dielectric cone sub-reflector assembly for 31.0-33.4 GHz operation, according to an embodiment of the present invention (for F/D≤0.25).

Referring now to FIG. 12B, a sub-reflector assembly 120*b* configured to preferentially support frequencies (f) in a range from about 14.4 GHz to about 15.35 GHz includes a dielectric block 10 disposed within a feed boom waveguide 3 and a sub-reflector (e.g., metal reflector) 15 at a distal end of the dielectric block 10. A plurality of corrugations are provided in the dielectric block 10 as a proximal groove 35 and a distal groove 40 having an angled distal sidewall 45. In contrast to the dielectric block 10 of FIG. 12A, the annular distal groove 40 in the dielectric block 10 of FIG. 12B has a smaller radius relative to the adjacent proximal groove 35. The sub-reflector assembly 120*b* also includes a metal choke plate 42 (with groove 43) having a maximum diameter that is greater than an outer diameter of the corresponding dielectric block 10 and sub-reflector 15.

Figure 12H:
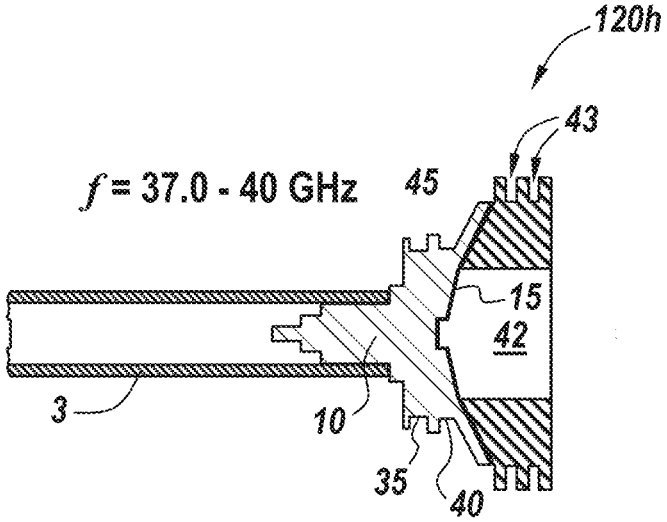
FIG. 12H is a cut-away side view of a dielectric cone sub-reflector assembly with metal choke plate for 37.0-40.0 GHz operation, according to an embodiment of the present invention (for F/D≤0.25).

Next, as shown by the sub-reflector assemblies 120*c*-120*g* of FIGS. 12C-12G, frequencies (f) in ranges from about 17 GHz to about 34 GHz may be supported using similarly-shaped dielectric blocks 10 of varying sizes and without the inclusion of metal choke plates (optional). And, as shown by FIG. 12H, a metal choke plate 42 having a pair of annular-shaped grooves 43, which are spaced longitudinally relative to each other and relative to the pair of proximal and distal grooves 35, 40, may be utilized within a sub-reflector assembly 120*h* that supports frequencies in a range from about 37 GHz to about 40 GHz.

Figure 13A:
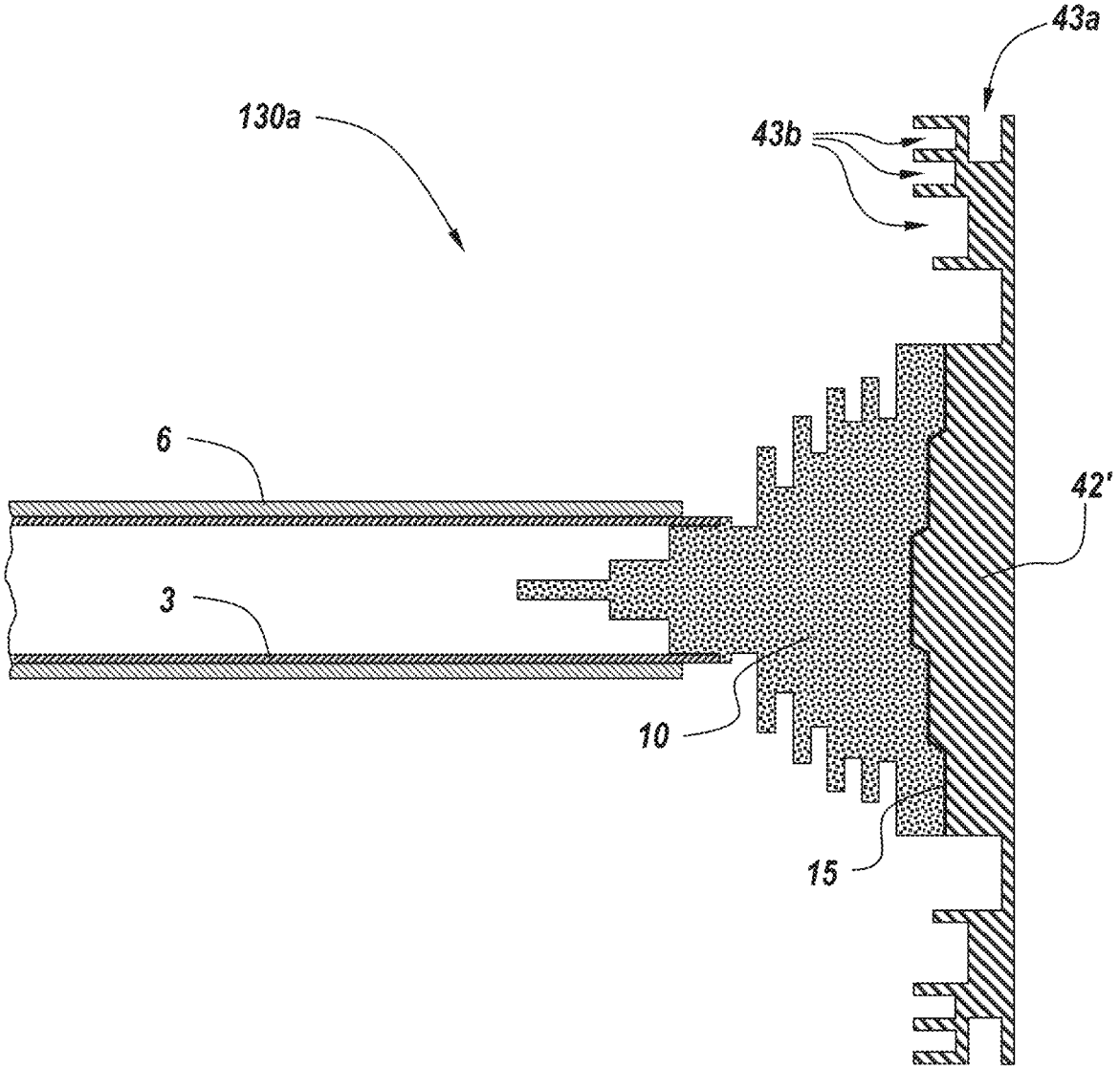
FIGS. 13A-13C are cut-away side views of sub-reflector assemblies with large diameter choke plates and radiation-absorbing wave guide sleeves, according to embodiments of the invention.
Figure 13B:
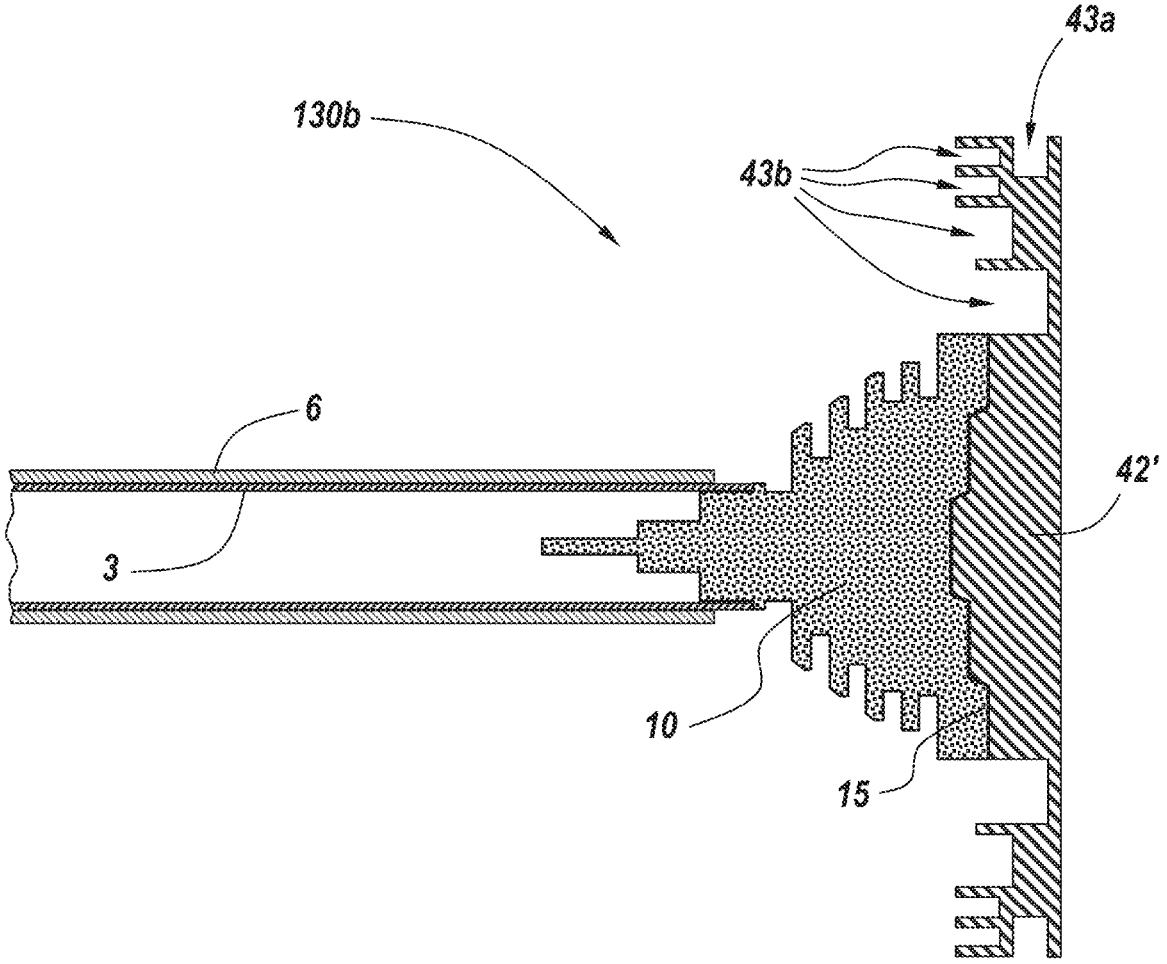
Figure 13C:
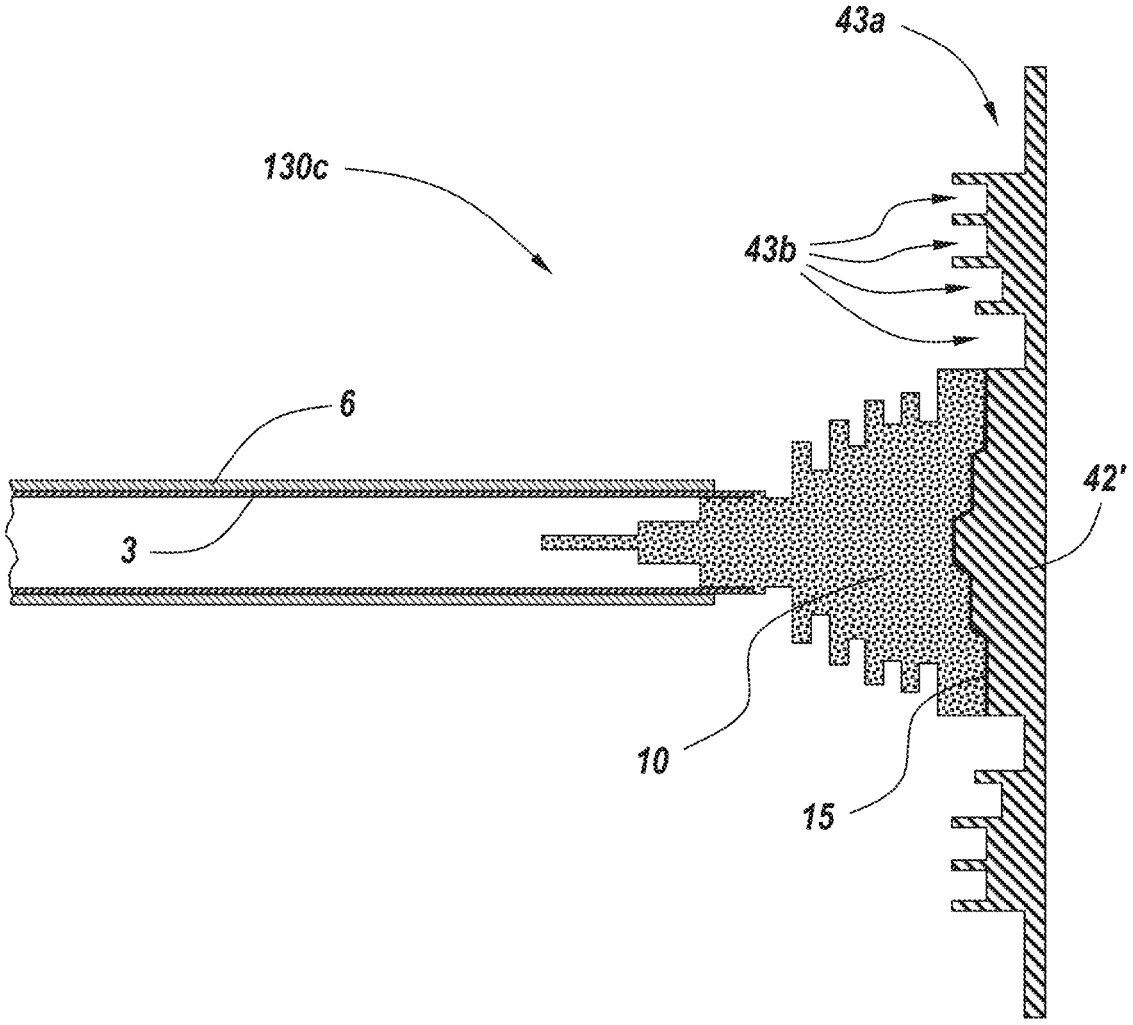
Figure 13D:
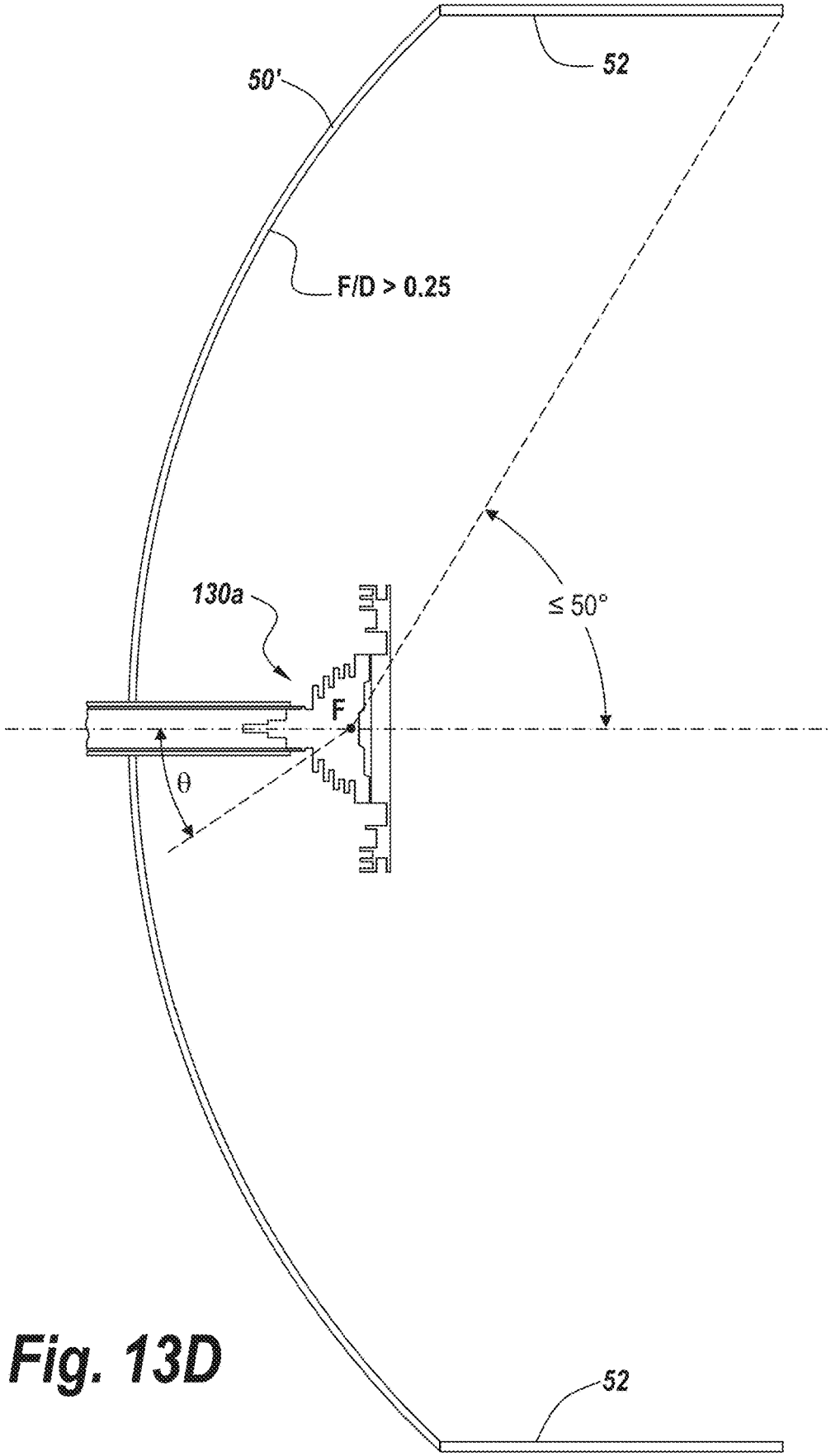
FIG. 13D is a cross-sectional schematic of a parabolic reflector antenna with cylindrically-shaped shield, according to embodiments of the invention.

Furthermore, as shown by FIGS. 13A-13D, the sub-reflector assemblies of FIGS. 12A-12H may be further modified to include a radiation absorbing sleeve 6, which is wrapped around at least a majority of a length of the feed boom waveguide 3, and a relatively large diameter metal choke plate 42'. For example, as highlighted by FIGS. 13A-13D, a radiation absorbing sleeve 6 may be provided to improve the radiation patterns extending adjacent the vertex of a relatively shallow dish reflector 50' of a dual-reflector antenna 132 (F/D>0.25). According to some embodiments of the invention, the radiation absorbing sleeve 6 may be formed of a material selected from a group consisting of foam, rubber, plastics and liquid-filled mediums. In addition, each of the illustrated metal choke plates 42' is shown as including a single annular groove 43*a* that is spaced longitudinally relative to a distal end of a dielectric block 10 (and sub-reflector 15) and a plurality of annular grooves 43*b* that are spaced-apart radially relative to each other. Finally, as best shown by FIG. 13D, a cylindrically-shaped shield 52, which is preferably internally lined with a radiation absorbing coating, can be coupled to a periphery of the dish reflector 50' to thereby further enhance the radiation patterns associated with the antenna 132. This shield 52 may have an outermost peripheral edge that is sufficiently spaced from a periphery of the dish reflector 50' so that a subtended angle "alpha" between a longitudinal axis of the sub-reflector assembly 130*a* and a line extending from a focal point (F) of the dish reflector 50' to a point on the distal peripheral edge of the absorber-lined shield 52 is less than about 50 degrees (i.e., $\alpha<50°$).

Figure 14A:
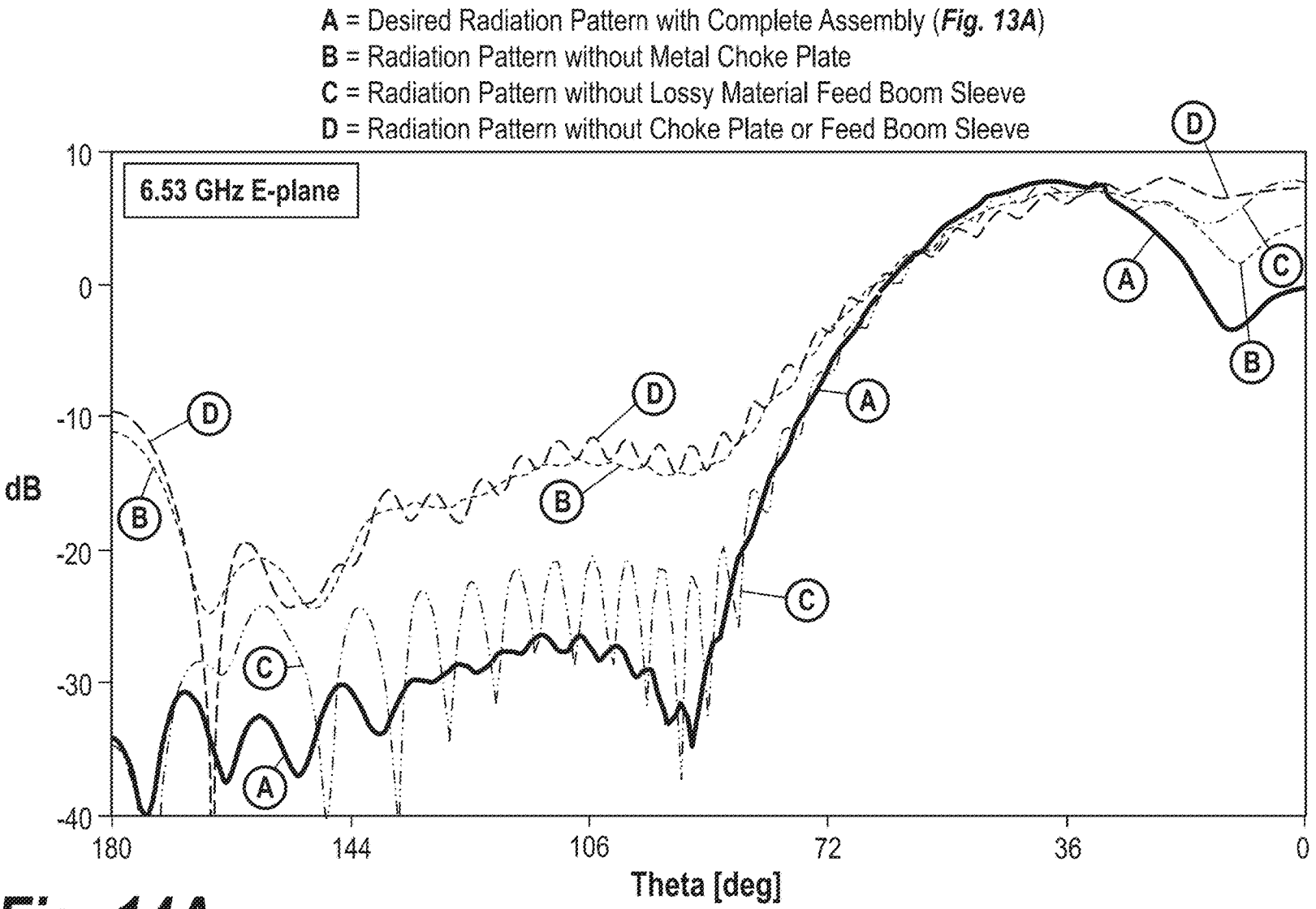
FIG. 14A illustrates a comparison of 6.53 GHz E-plane primary radiation patterns associated with a parabolic reflector antenna (F/D=0.4) having the sub-reflector assembly of FIG. 13A (and variations thereof), but without absorber-lined shield.
Figure 14B:
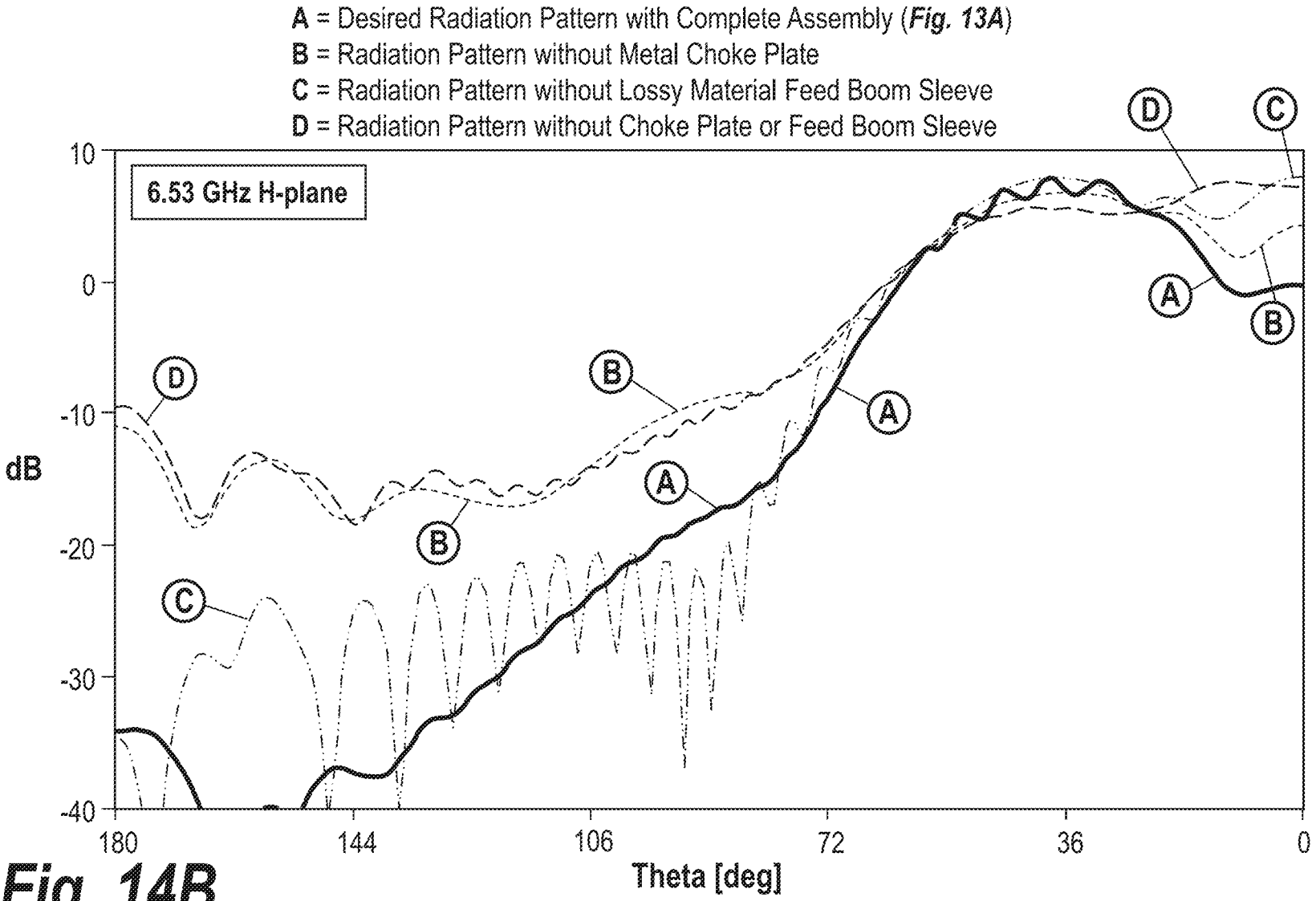
FIG. 14B illustrates a comparison of 6.53 GHz H-plane primary radiation patterns associated with a parabolic reflector antenna (F/D=0.4) having the sub-reflector assembly of FIG. 13A (and variations thereof), but without absorber-lined shield.
Figure 15A:
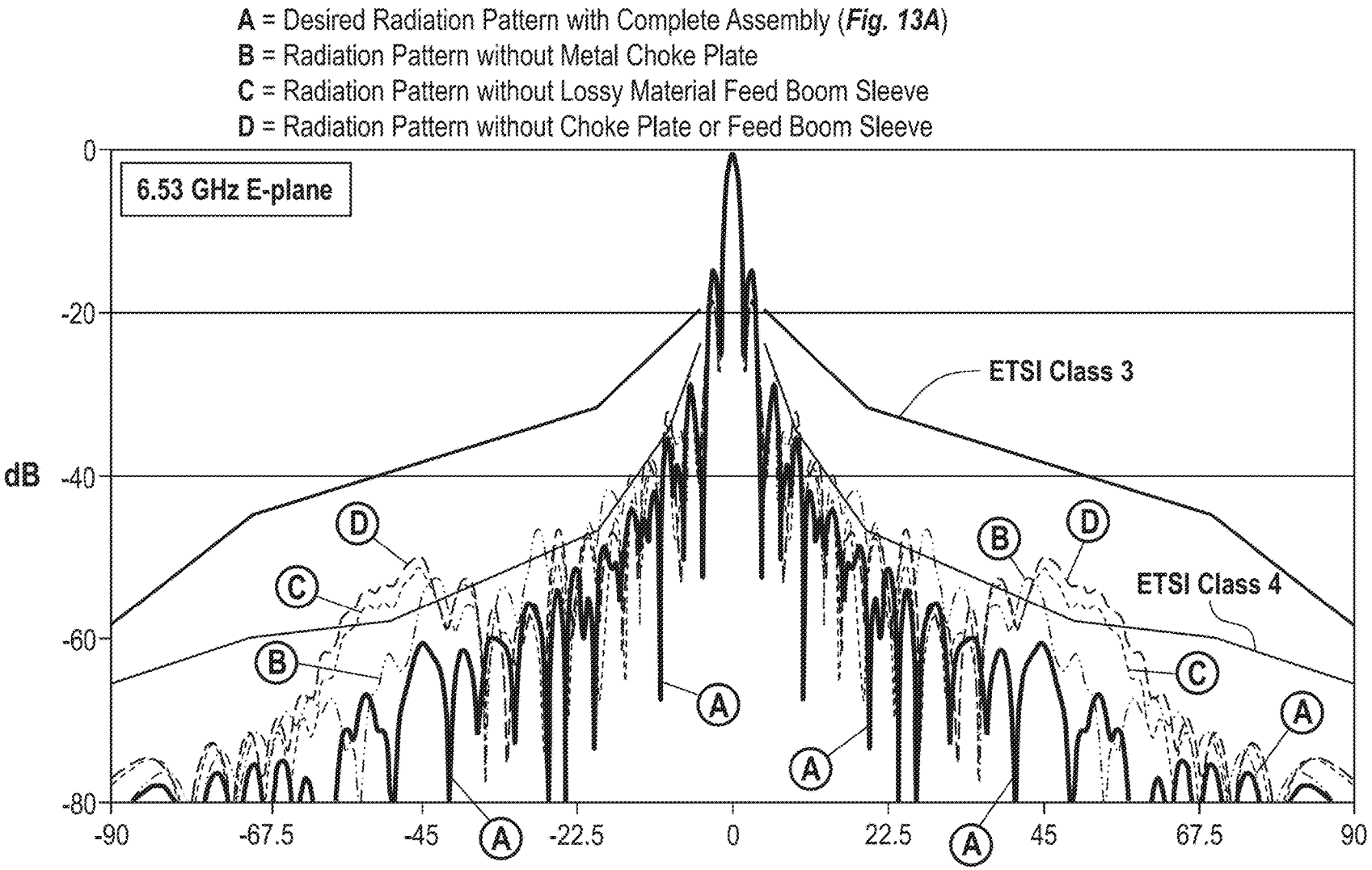
FIG. 15A illustrates a comparison of 6.53 GHz E-plane secondary radiation patterns associated with a parabolic reflector antenna (F/D=0.4) having the sub-reflector assembly of FIG. 13A (and variations thereof), with absorber-lined shield.
Figure 15B:
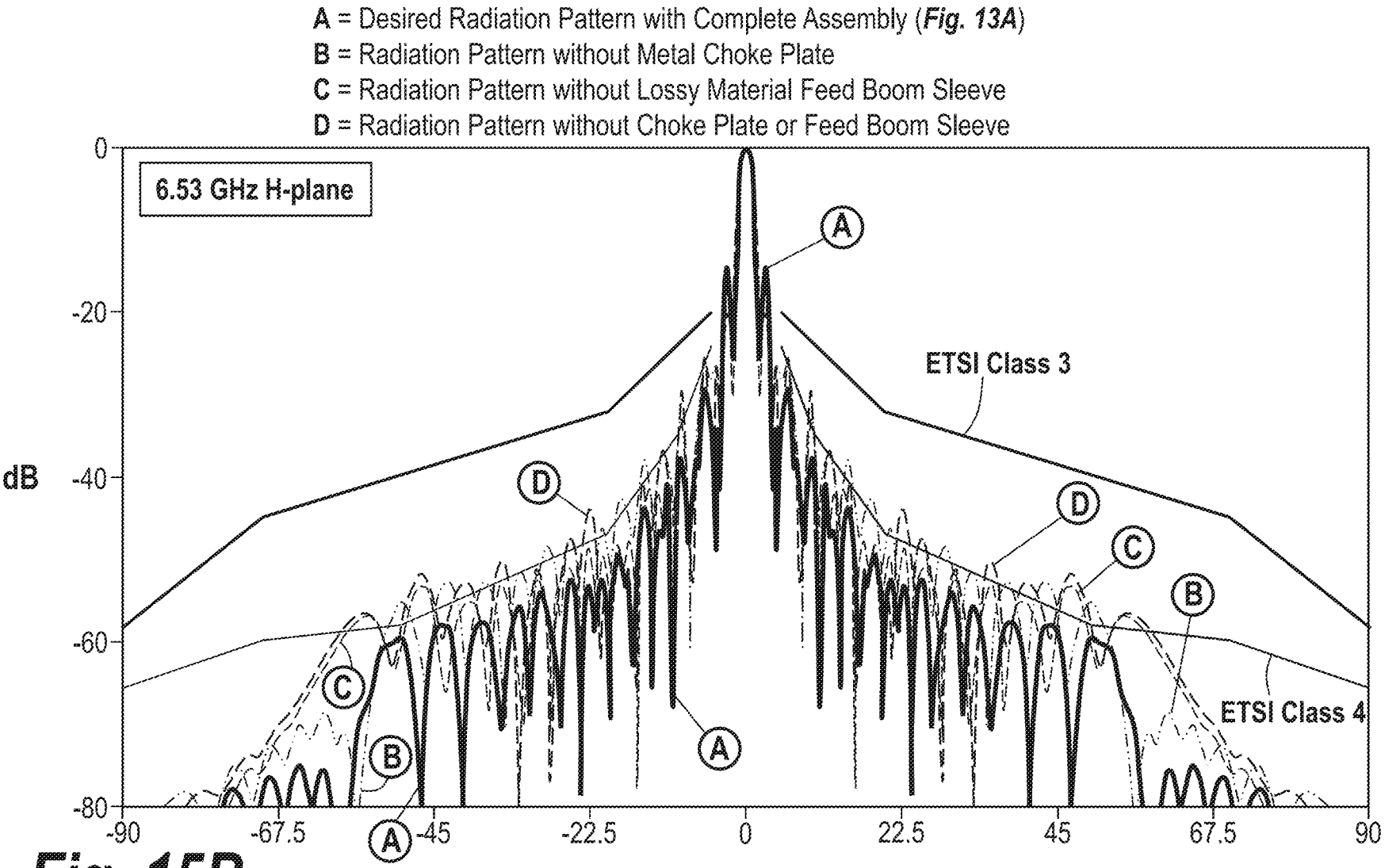
FIG. 15B illustrates a comparison of 6.53 GHz H-plane secondary radiation patterns associated with a parabolic reflector antenna (F/D=0.4) having the sub-reflector assembly of FIG. 13A (and variations thereof), with absorber-lined shield.

FIGS. 14A-14B illustrate a comparison of 6.53 GHz E-plane and H-plane primary radiation patterns for a parabolic reflector antenna with an F/D ratio of about 0.4 and have: (A) the complete sub-reflector assembly 130*a* of FIG. 13A; (B) assembly 130*a* but without choke plate 42'; (C) assembly 130*a* but without lossy material feed boom sleeve 6; and (D) assembly 130*a* but without choke plate 42' or lossy material feed boom sleeve 6. Similarly, FIGS. 15A-15B illustrate a corresponding comparison of 6.53 GHz E-plane and H-plane secondary radiation patterns, with ETSI Class 3 and Class 4 radiation pattern specifications highlighted. As shown by curve "A" in FIGS. 14A-14B, in the range where θ (theta) is between about 25 degrees and about 35 degrees, approximately 90% of energy provided from feed assembly illuminates the dish reflector 50', whereas curves B-D show significant deterioration in dish reflector illumination, particularly in regions near the feed boom where θ (theta) is less than about 30 degrees. ETSI Class 4 performance is also demonstrated for only the "complete" sub-reflector assembly of curve "A", as shown by FIG. 13A and FIGS. 15A-15B.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A parabolic reflector antenna, comprising:

a dish reflector having an F/D ratio greater than 0.25;

a feed boom waveguide having a promixal end coupled to said dish reflector;

a sub-reflector assembly comprising a dielectric block coupled to a distal end of said feed boom waveguide;

a cylindrically-shaped shield coupled to a periphery of said dish reflector, said cylindrically-shaped shield having an outermost peripheral edge that is sufficiently spaced from the periphery of said dish reflector that a subtended angle between a longitudinal axis of the sub-reflector assembly and a line extending from a focal point of the dish reflector to a point on the outermost peripheral edge of the cylindrically-shaped shield is less than 50 degrees; and a radiation absorbing sleeve wrapped around at least a majority of a length of the feed boom waveguide.

2. The antenna of claim 1, wherein the sub-reflector assembly further comprises a sub-reflector adjacent a distal end of the dielectric block.

3. The antenna of claim 1, further comprising a radiation absorbing liner on at least a portion of an interior surface of the cylindrically-shaped shield.

4. The antenna of claim 2, further comprising:

a radiation absorbing liner on at least a portion of an interior surface of the cylindrically-shaped shield.

5. A parabolic reflector antenna, comprising:

a dish reflector having an F/D ratio greater than 0.25;

a feed boom waveguide having a promixal end coupled to said dish reflector;

a sub-reflector assembly comprising a dielectric block coupled to a distal end of said feed boom waveguide; and a cylindrically-shaped shield coupled to a periphery of said dish reflector, said cylindrically-shaped shield having an outermost peripheral edge that is sufficiently spaced from the periphery of said dish reflector that a subtended angle between a longitudinal axis of the sub-reflector assembly and a line extending from a focal point of the dish reflector to a point on the outermost peripheral edge of the cylindrically-shaped shield is less than 50 degrees;

wherein the F/D ratio is in a range from about 0.36 to about 0.44; and wherein the sub-reflector assembly further comprises a sub-reflector adjacent a distal end of the dielectric block, and a choke plate coupled to the distal end of the dielectric block, said choke plate having a maximum diameter equal to or greater than an outer diameter of the sub-reflector.

6. The antenna of claim 5, wherein the choke plate and the sub-reflector comprise different materials; and wherein the choke plate comprises a metal.

7. The antenna of claim 1, wherein said radiation absorbing sleeve comprises a material selected from a group consisting of foam, rubber, plastics and liquid-filled mediums.

* * * * *